US008360817B2

(12) United States Patent
Ishii et al.

(10) Patent No.: US 8,360,817 B2
(45) Date of Patent: Jan. 29, 2013

(54) POLISHING APPARATUS AND POLISHING METHOD

(75) Inventors: Yu Ishii, Tokyo (JP); Yoichi Shiokawa, Tokyo (JP); Jyoji Heianna, Tokyo (JP); Hisanori Matsuo, Tokyo (JP)

(73) Assignee: Ebara Corporation, Tokyo (JP)

( * ) Notice: Subject to any disclaimer, the term of this patent is extended or adjusted under 35 U.S.C. 154(b) by 372 days.

(21) Appl. No.: 12/730,409

(22) Filed: Mar. 24, 2010

(65) Prior Publication Data

US 2010/0255756 A1 Oct. 7, 2010

(30) Foreign Application Priority Data

Apr. 1, 2009 (JP) ..... 2009-89068
Apr. 14, 2009 (JP) ..... 2009-97692

(51) Int. Cl.
*B24B 1/00* (2006.01)

(52) U.S. Cl. ..... 451/5; 451/60; 451/446; 451/285; 451/287

(58) Field of Classification Search ..... 451/5, 60, 451/285–289, 446
See application file for complete search history.

(56) References Cited

U.S. PATENT DOCUMENTS

| | | | | |
|---|---|---|---|---|
| 5,709,593 | A | 1/1998 | Guthrie et al. | |
| 5,791,970 | A * | 8/1998 | Yueh | 451/8 |
| 5,857,893 | A * | 1/1999 | Olsen et al. | 451/5 |
| 6,074,276 | A * | 6/2000 | Shibata et al. | 451/8 |
| 6,139,406 | A * | 10/2000 | Kennedy et al. | 451/67 |
| 6,183,341 | B1 * | 2/2001 | Melcer | 451/5 |
| 6,546,306 | B1 * | 4/2003 | Bushman et al. | 700/121 |
| 6,722,943 | B2 * | 4/2004 | Joslyn | 451/5 |
| 6,884,145 | B2 * | 4/2005 | Lujan et al. | 451/5 |
| 6,926,584 | B2 * | 8/2005 | Chang et al. | 451/5 |
| 6,984,162 | B2 * | 1/2006 | Bright et al. | 451/5 |
| 7,004,824 | B1 * | 2/2006 | Madanshetty | 451/60 |
| 7,930,058 | B2 * | 4/2011 | Bhagavat et al. | 700/164 |
| 2004/0198184 | A1 * | 10/2004 | Joslyn | 451/5 |
| 2006/0105678 | A1 | 5/2006 | Kohama et al. | |
| 2007/0233306 | A1 * | 10/2007 | Takada | 700/121 |
| 2007/0239309 | A1 * | 10/2007 | Tada et al. | 700/121 |
| 2008/0248723 | A1 * | 10/2008 | Yokoyama et al. | 451/5 |

FOREIGN PATENT DOCUMENTS

| | | |
|---|---|---|
| JP | 10-034535 | 2/1998 |
| JP | 10-58309 | 3/1998 |
| JP | 10-286758 | 10/1998 |
| JP | 2001-237208 | 8/2001 |
| JP | 2002-113653 | 4/2002 |
| JP | 2003-133277 | 5/2003 |
| JP | 2004-306173 | 11/2004 |
| JP | 2006-147773 | 6/2006 |
| JP | 2008-503356 | 2/2008 |

* cited by examiner

*Primary Examiner* — George Nguyen
(74) *Attorney, Agent, or Firm* — Wenderoth, Lind & Ponack, L.L.P.

(57) ABSTRACT

A polishing apparatus can perform more precise control of a polishing profile without carrying out many polishing tests in advance. The polishing apparatus includes: a polishing table 22 having a polishing surface 52*a*; a top ring 24 for holding a polishing object W and pressing the polishing object W against the polishing surface 52*a*; a polishing liquid supply nozzle 26 for supplying a polishing liquid to the polishing surface 52*a*; a movement mechanism 70 for moving a polishing liquid supply position 26*a* of the polishing liquid supply nozzle 26 approximately along the radial direction of the polishing surface 52*a*; a controller 66 for controlling the movement mechanism 70; and a simulator 72 for predicting the relationship between the polishing liquid supply position 26*a* of the polishing liquid supply nozzle 26 and a polishing profile, performing a simulation and outputting data to the controller 66.

12 Claims, 24 Drawing Sheets

POLISHING APPARATUS AND POLISHING METHOD

BACKGROUND OF THE INVENTION

1. Field of the Invention

The present invention relates to a polishing apparatus and a polishing method, and more particularly to a polishing apparatus and a polishing method for polishing and flattening a polishing object, such as a semiconductor wafer, with the use of a polishing liquid (slurry).

2. Description of the Related Art

With the recent progress toward higher integration of semiconductor devices, circuit interconnects are becoming finer and the distance between adjacent interconnects is becoming smaller. Especially when forming a circuit pattern by optical lithography with a line width of not more than 0.5 μm, a stepper requires a high flatness of imaging surface because of the small depth of focus. A polishing apparatus for carrying out chemical mechanical polishing (CMP) with the use of a polishing liquid is known as such a means for flattening a surface of a semiconductor wafer.

Such a chemical mechanical polishing (CMP) apparatus includes a polishing table having, on its upper surface, a polishing pad, and a top ring. A semiconductor wafer is put between the polishing table and the top ring, and the semiconductor wafer, held by the top ring, is pressed against a polishing surface of the polishing pad while supplying an abrasive liquid (slurry) to the polishing surface, thereby polishing a surface of the semiconductor wafer into a flat mirror-like surface (see Japanese Patent Laid-Open Publication Nos. 2002-113653, H10-58309, H10-286758, 2003-133277 and 2001-237208).

The applicant has proposed a polishing apparatus and a polishing method which can achieve increased polishing rate and enhanced in-plane uniformity of polishing rate by the provision of a polishing liquid supply port for supplying a polishing liquid to a polishing surface and of a movement mechanism for moving the polishing liquid supply port so that the polishing liquid will uniformly spread over an entire surface of a polishing object due to the relative movement between the polishing object and the polishing surface (see Japanese Patent Laid-Open Publication No. 2006-147773).

The applicant has also proposed a polishing apparatus which uses a top ring having a plurality of pressure chambers for independently applying pressures on a plurality of areas of a polishing object and independently controls the pressures on the plurality of areas of the polishing object (see Japanese Patent Laid-Open Publication No. 2008-503356). A polishing apparatus is also known which uses air bags to independently control pressures on a plurality of areas of a polishing object.

SUMMARY OF THE INVENTION

The recent demand for higher-performance semiconductor devices necessitates more precise control of polishing profiles. A conceivable method for obtaining a desired polishing profile is to use a top ring having a plurality of pressure chambers, air bags, or the like for independently applying pressures on a plurality of areas of a polishing object and to carry out polishing of the polishing object while independently controlling the pressures on the areas of the polishing object. This method, however, cannot control the pressure on a smaller area than a pressure chamber, an air bag or the like, making it impossible to control the polishing profile for such small areas. More precise profile control is thus difficult.

Meanwhile, compared to the method of using a top ring having a plurality of pressure chambers, air bags, or the like, more precise control of a polishing profile can be performed by a method which comprises supplying a polishing liquid from a polishing liquid supply port (polishing liquid supply position) to a polishing surface while moving the polishing liquid supply port in carrying out polishing. This method, however, necessitates many control parameters. This requires many polishing tests until an intended polishing profile is obtained, which also incurs increased cost of consumables, such as a semiconductor wafer.

From the viewpoints of processing cost and environment, there is a strong demand for reduction in the use of consumables for polishing in a polishing apparatus. In particular, a polishing liquid (slurry) for use in chemical mechanical polishing (CMP) is not only costly, but also entails a heavy burden on its waste (discharge) treatment. To reduce the use of a polishing liquid as much as possible without wasting the polishing liquid is therefore highly demanded.

The present invention has been made in view of the above situation. It is therefore a first object of the present invention to provide a polishing apparatus and a polishing method which can perform more precise control of a polishing profile without carrying out many polishing tests in advance.

It is a second object of the present invention to provide a polishing method which can reduce the consumption of a polishing liquid while maintaining a relatively high polishing rate.

In order to achieve the above objects, the present invention provides a polishing apparatus comprising: a polishing table having a polishing surface; a top ring for holding a polishing object and pressing the polishing object against the polishing surface; a polishing liquid supply nozzle for supplying a polishing liquid to the polishing surface; a movement mechanism for moving a polishing liquid supply position of the polishing liquid supply nozzle approximately along the radial direction of the polishing surface; a controller for controlling the movement mechanism; and a simulator for predicting the relationship between the polishing liquid supply position of the polishing liquid supply nozzle and a polishing profile, performing a simulation and outputting data to the controller.

With the provision of the simulator for predicting the relationship between the polishing liquid supply position of the polishing liquid supply nozzle and a polishing profile, performing a simulation and outputting data to the controller, it becomes possible to efficiently determine a polishing recipe, such as a movement pattern of the polishing liquid supply position, without carrying out many polishing tests in advance, and to control a polishing profile more precisely than the conventional method using an air bag or the like.

Preferably, the simulator, based on input of an intended polishing profile and by referring to a database containing information on pre-determined relationships between a plurality of polishing liquid supply positions and polishing profiles, outputs a movement pattern of the polishing liquid supply position by which the intended polishing profile is expected to be obtained.

The simulator, based on input of a movement pattern of the polishing liquid supply position and by referring to a database containing information on pre-determined relationships between a plurality of polishing liquid supply positions and polishing profiles, may output a polishing profile which is expected to be obtained when polishing is carried out while moving the polishing liquid supply position in accordance with the movement pattern.

The simulator, by referring to a database containing information on pre-determined relationships between a plurality of polishing liquid supply positions and polishing profiles, may predict the relationship between an arbitrary polishing liquid supply position and a polishing profile by using at least one of n-dimensional regression, Fourier transform, spline regression and wavelet transform.

The simulator, based on superposition of polishing profiles which are weighted by the movement speed or the residence time of the polishing liquid supply position in an arbitrary small section, may predict a polishing profile which will be obtained if polishing is carried out while moving the polishing liquid supply position.

In a preferred aspect of the present invention, the polishing apparatus is provided with a film thickness monitor, and the simulator predicts the optimal movement pattern of the polishing liquid supply position from the results of measurements with the film thickness monitor during polishing, and feeds back the predicted pattern to the controller.

The film thickness monitor is, for example, comprised of an eddy current sensor. An eddy current sensor can measure a thickness of a metal film.

The film thickness monitor may be an optical sensor. An optical sensor can measure a thickness of an optically transparent film, such as an oxide film.

In a preferred aspect of the present invention, the polishing apparatus is provided with a polishing profile monitor, and the results of measurement with the polishing profile monitor after polishing is inputted as an actual polishing profile into the simulator.

The present invention also provides a polishing method for polishing a polishing object by pressing the polishing object against a polishing surface of a polishing table while supplying a polishing liquid from a polishing liquid supply nozzle to the polishing surface and rotating at least the polishing surface, said method comprising moving a polishing liquid supply position of the polishing liquid supply nozzle, from which the polishing liquid is supplied to the polishing surface, approximately along the radial direction of the polishing surface and in a predetermined movement pattern, individually determined for each of divided movement sections in a movement range of the polishing liquid supply position.

By thus moving the polishing liquid supply position of the polishing liquid supply nozzle, from which a polishing liquid is supplied to the polishing surface, approximately along the radial direction of the polishing surface and in a predetermined movement pattern, individually determined for each of divided movement sections in a movement range of the polishing liquid supply position, it becomes possible to control the polishing profile more precisely than the conventional method using an air bag or the like.

Preferably, the movement pattern of the polishing liquid supply position includes one of the movement speed, the divisional position and the movement range in each of the divided movement sections in the movement range The movement pattern of the polishing liquid supply position may be a movement pattern determined by a simulator based on an intended polishing profile.

This makes it possible to efficiently determine a polishing recipe, such as the movement pattern of the polishing liquid supply position, without carrying out many polishing tests in advance.

In a preferred aspect of the present invention, the difference between an intended polishing profile and a polishing profile measured with a film thickness monitor during polishing is calculated, and a simulation is performed by a simulator based on the calculated difference to update the movement pattern of the polishing liquid supply position so as to bring it closer to a preset polishing profile.

In a preferred aspect of the present invention, for at least two types of films formed in the polishing object and having different polishing profiles, the movement pattern of the polishing liquid supply position is determined by a simulator individually for each of the films based on an intended polishing profile.

This can improve the polishing profile of a polishing object having two types of films with different polishing profiles, such as an $SiO_2$ film and a metal film.

According to the polishing apparatus and the polishing method of the present invention, the use of the simulator makes it possible to efficiently determine a polishing recipe, such as the movement pattern of the polishing liquid supply position, without carrying out many polishing tests in advance, and to control the polishing profile more precisely than the conventional method using an air bag or the like.

The present invention provides another polishing method for polishing a polishing object by pressing the polishing object against a polishing surface of a polishing table while supplying a polishing liquid from a polishing liquid supply nozzle to the polishing surface and rotating at least the polishing surface, said method comprising moving a polishing liquid supply position of the polishing liquid supply nozzle, from which the polishing liquid is supplied to the polishing surface, in the range between a first supply position corresponding to the center-side track of an edge of the polishing object on the polishing surface and a second supply position corresponding to the track of a center of the polishing object on the polishing surface while supplying the polishing liquid from the polishing liquid supply nozzle to the polishing surface.

By thus restricting the range of movement of the polishing liquid supply position of the polishing liquid supply nozzle such that a polishing liquid is supplied from the polishing liquid supply nozzle during polishing to the limited range corresponding to approximately the radius of a polishing object, ranging from the center to the edge of the polishing object, it becomes possible to reduce the use of the polishing liquid while maintaining a high polishing rate.

Preferably, the polishing liquid supply position of the polishing liquid supply nozzle is moved over the polishing table along approximately the radial direction of the polishing table.

The polishing liquid supply position of the polishing liquid supply nozzle may be moved over the polishing table along approximately the circumferential direction of the polishing table.

In a preferred aspect of the present invention, the movement speed of the polishing liquid supply position of the polishing liquid supply nozzle is changed with the movement of the polishing liquid supply position.

For example, the polishing liquid supply position of the polishing liquid supply nozzle is moved from the first supply position to the second supply position while increasing the movement speed of the polishing liquid supply position gradually or stepwise, and the polishing liquid supply position of the polishing liquid supply nozzle is moved from the second supply position to the first supply position while decreasing the movement speed of the polishing liquid supply position gradually or stepwise. This makes it possible to supply a polishing liquid in a larger amount to a low-speed rotation area than to a high-speed rotation area.

In a preferred aspect of the present invention, the movement range between the first supply position and the second supply position is divided into a plurality of movement sections, and the movement speed of the polishing liquid supply position of the polishing liquid supply nozzle is set for each movement section.

For example, the movement range between the first supply position and the second supply position is divided into 11 movement sections, and the optimal movement speed of the polishing liquid supply position of the polishing liquid supply nozzle is set for each movement section. It has been confirmed that this can significantly reduce the use of a polishing liquid while maintaining a high polishing rate.

According to the polishing method of the present invention, the consumption of a polishing liquid can be reduced while maintaining a relatively high polishing rate.

DETAILED DESCRIPTION OF THE PREFERRED EMBODIMENTS

Figure 1:
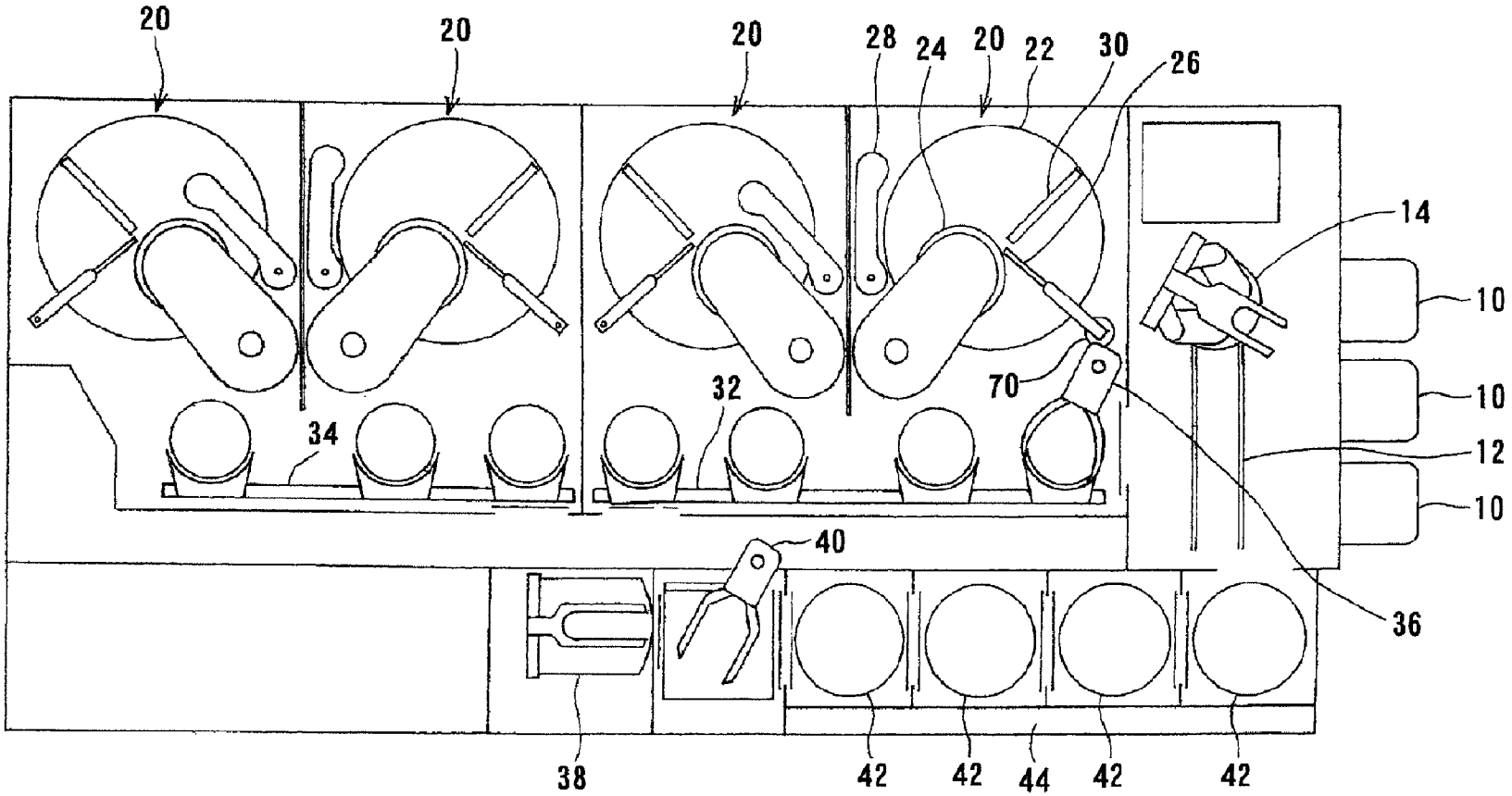
FIG. 1 is a plan view showing a polishing system incorporating a polishing apparatus according to an embodiment of the present invention.

Preferred embodiments of the present invention will now be described with reference to the drawings. The following description illustrates an exemplary case in which a metal film, such as a copper film, formed in a surface of a semiconductor wafer as a polishing object is polished. In the drawings, the same reference numerals are used for the same or equivalent components, and a duplicate description thereof will be omitted.

FIG. 1 is a plan view showing a polishing system incorporating a polishing apparatus according to an embodiment of the present invention. As shown in FIG. 1, the polishing system can be equipped with three wafer cassettes 10. A traveling mechanism 12 is provided along the wafer cassettes 10. On the traveling mechanism 12 is provided a first transport robot 14 having two hands which can reach the wafer cassettes 10.

The polishing system is also provided with four polishing apparatuses 20 each according to an embodiment of the present invention. The polishing apparatuses 20 are arranged along the longitudinal direction of the system. Each polishing apparatus 20 includes a polishing table 22 having a polishing surface, a top ring 24 for holding a semiconductor wafer as a polishing object and pressing the semiconductor wafer against a polishing pad 52 (see FIG. 2) to polish the wafer, a polishing liquid supply nozzle 26 for supplying a polishing liquid (slurry) to the polishing pad 52, a dresser 28 for carrying out dressing of the polishing table 22, and an atomizer 30 for spraying a misty mixed fluid of a liquid (e.g., pure water) and a gas (e.g., nitrogen) to the polishing surface from one or more nozzles.

A first linear transporter 32 and a second linear transporter 34 for transporting a semiconductor wafer along the longitudinal direction of the system are disposed near the polishing apparatuses 20. A reversing machine 36 for reversing a semiconductor wafer received from the first transport robot 14 is disposed on the wafer cassette 10 side of the first linear transporter 32.

The polishing system also includes a second transport robot 38, a reversing machine 40 for reversing a semiconductor wafer received from the second transport robot 38, four cleaning machines 42 for cleaning a semiconductor wafer after polishing, and a transport unit 44 for transporting a semiconductor wafer between the reversing machine 40 and the cleaning machines 42. The second transport robot 38, the reversing machine 40 and the cleaning machines 42 are arranged in series along the longitudinal direction of the system.

In this polishing system, a semiconductor wafer from one wafer cassette 10 is transported to one polishing apparatus 20 via the reversing machine 36, the first linear transporter 32 and the second linear transporter 34, and the semiconductor wafer is polished in the polishing apparatus 20. The semiconductor wafer after polishing is transported to the cleaning machines 42 via the second transport robot 38 and the reversing machine 40, and cleaned in the cleaning machines 42. The semiconductor wafer after cleaning is returned by the first transport robot 14 to the wafer cassette 10.

Figure 2:
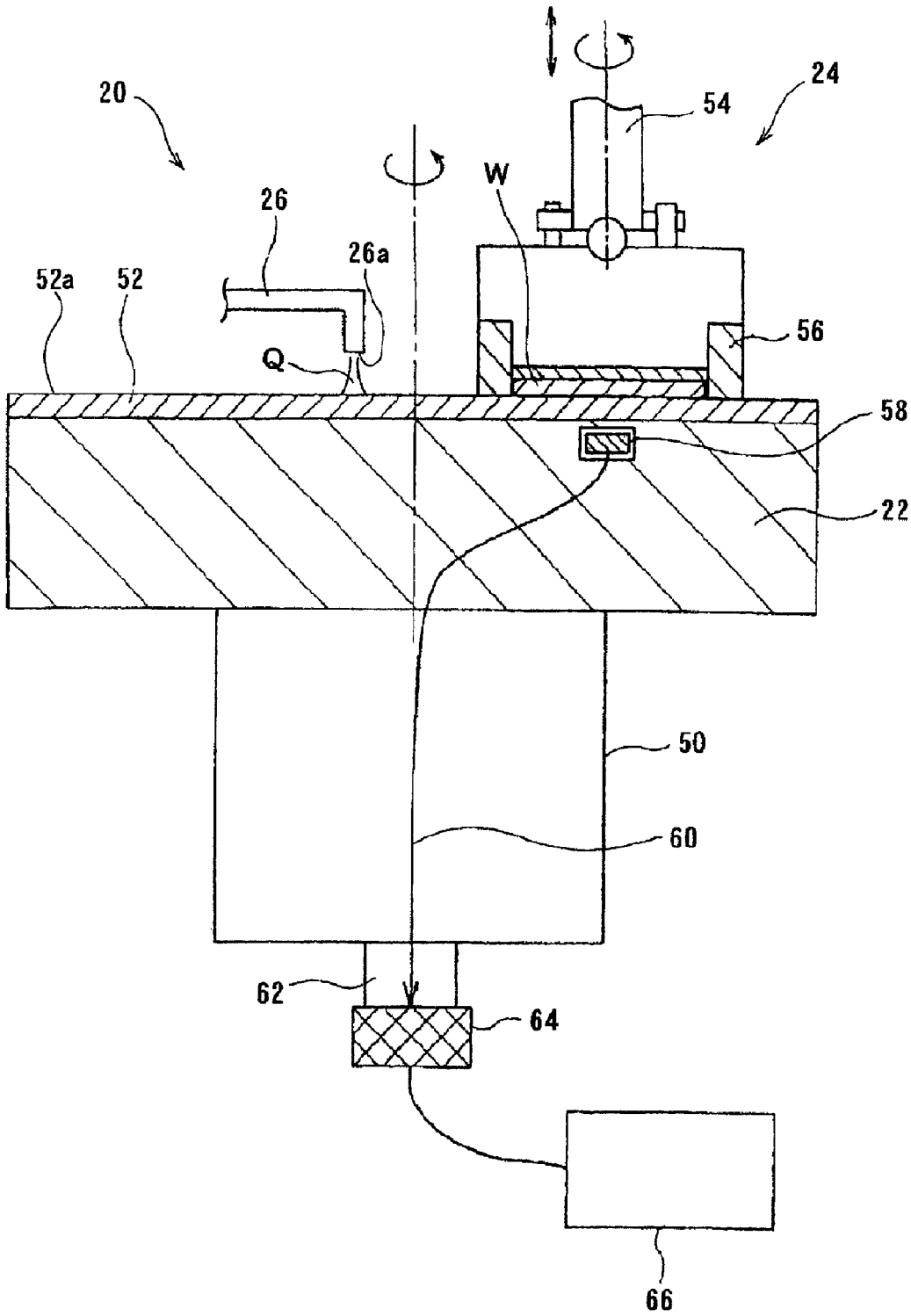
FIG. 2 is a vertical sectional view schematically showing the polishing apparatus according to the present invention provided in the polishing system shown in FIG. 1.
Figure 3:
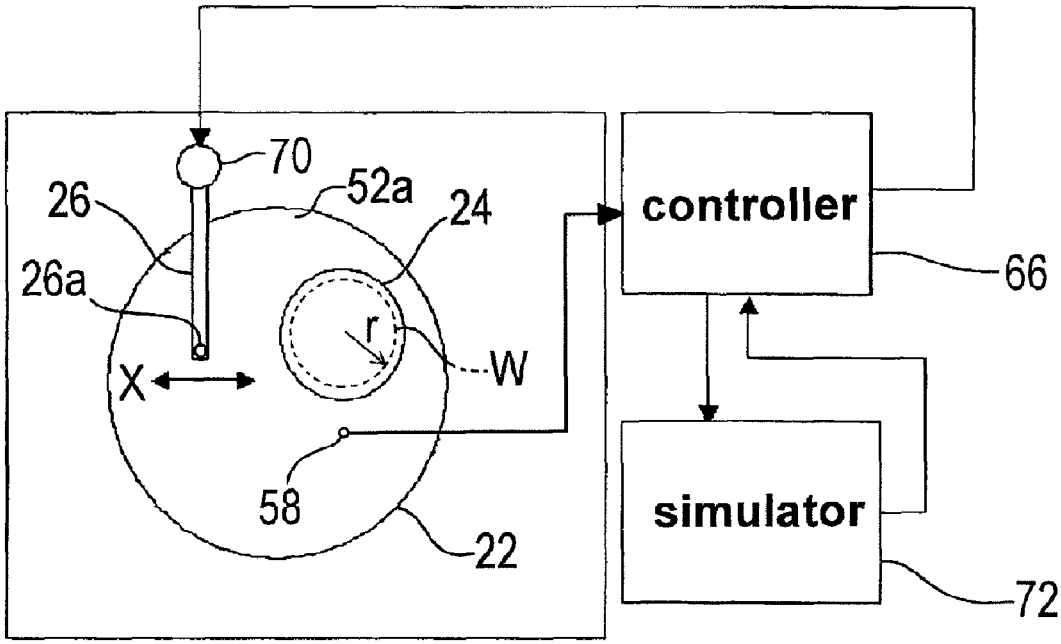
FIG. 3 is a diagram illustrating the construction of the system of the polishing apparatus shown in FIG. 2.

FIG. 2 is a vertical sectional view showing a portion of the polishing apparatus 20, and FIG. 3 is a diagram showing the construction of the system of the polishing apparatus 20. As shown in FIG. 2, the polishing table 22 of the polishing apparatus 20 is coupled to a motor 50 disposed under the table 22, and thus is rotatable about its axis as shown by the arrow. A polishing pad (polishing cloth) 52 having a polishing surface 52*a* is attached to an upper surface of the polishing table 22. The top ring 24 is coupled to a top ring shaft 54. The top ring 24 has, in its lower peripheral portion, a retainer ring 56 for holding the periphery of a semiconductor wafer W.

The top ring 24 is coupled to a motor (not shown) and also coupled to a lifting cylinder (not shown). Thus, the top ring 24 is vertically movable and rotatable about its axis as shown by the arrows, so that it can press the semiconductor wafer W against the polishing surface 52*a* of the polishing pad 52 at an arbitrary pressure.

In the table 22 is embedded an eddy current sensor 58, as a film thickness monitor, for measuring a thickness of a metal film, such as a copper film, formed in the surface of the semiconductor wafer W. Wiring 60 extending from the eddy current sensor (film thickness monitor) 58 passes through the polishing table 22 and a support shaft 62, and is connected to a controller 66 via a rotary connector (or slip ring) 64 provided at an end of the support shaft 62. With this arrangement, when the eddy current sensor 58 is moving beneath and across the semiconductor wafer W, the thickness of the conductive film, such as a copper film, formed in the surface of the semiconductor wafer W can be measured continuously along the trajectory of the eddy current sensor 58.

In this embodiment, a thickness of a metal film, such as a copper film, formed in a surface of a semiconductor wafer is measured by using an eddy current sensor. It is also possible to use an optical sensor instead of an eddy current sensor to measure an optically transparent film, such as an oxide film, formed in a surface of a semiconductor wafer during polishing.

Tough not shown diagrammatically, the polishing apparatus 20 may be provided with a polishing profile monitor for measuring the post-polishing profile of a surface of a semiconductor wafer, and the results of measurement with the polishing profile monitor may be inputted as an actual polishing profile into a simulator 72 (see FIG. 3).

As shown in FIG. 3, the polishing liquid supply nozzle 26 pivots horizontally above the polishing surface 52*a* by the rotation of a stepping motor 70 as a movement mechanism, and, by the pivot movement of the polishing liquid supply nozzle 26, a downward-facing polishing liquid supply port 26*a* at a front end of the nozzle 26, i.e., a polishing liquid supply position, moves along approximately the radial direction of the polishing surface 52*a*. The stepping motor (movement mechanism) 70 is connected to the controller 66.

To the controller 66 is connected a simulator 72 which predicts the relationship between the polishing liquid supply port (polishing liquid supply position) 26*a* of the polishing liquid supply nozzle 26 and a polishing profile which will be obtained if polishing is carried out while supplying a polishing liquid to the polishing surface 52*a* from the polishing liquid supply position, and performs a simulation, e.g., based on an intended polishing profile.

Table 1 shows an example of a database which has been determined by the simulator 72 and stored in the simulator 72.

TABLE 1

| | 10 | 80 | 150 | Polishing liquid |
|---|---|---|---|---|
| 0 | 728.01514 | 718.81102 | 795.20264 | supply position: X |
| 3.625 | 715.40527 | 712.68921 | 785.5896 | |
| 7.25 | 700.04272 | 709.17358 | 777.28272 | |
| 10.875 | 704.37622 | 708.3313 | 749.36523 | |
| 14.5 | 698.40699 | 711.00463 | 751.33056 | |
| 18.125 | 698.49244 | 700.90942 | 743.45702 | |
| 21.75 | 701.12305 | 703.70483 | 727.15454 | |
| 25.375 | 696.28297 | 701.46486 | 717.7124 | Polishing rate: RR(X, r) |
| . | . | . | . | |
| . | . | . | . | |
| . | . | . | . | |
| 139.125 | 689.47144 | 689.48974 | 652.22168 | |
| 142.75 | 687.47559 | 682.15942 | 653.58278 | |
| 146.375 | 686.26709 | 679.49219 | 633.42285 | |
| 150 | 683.81958 | 678.38135 | 627.47192 | |
| Wafer position: r | | | | |

As shown in Table 1, the database stored in the simulator 72 contains information on polishing rates RR (X, r) (nm/min) at intersections between a plurality of polishing liquid supply positions "X" (mm) of the polishing liquid supply ports 26*a* of the polishing liquid supply nozzle 26 along the X-direction shown in FIG. 3 and radial positions "r" (mm) on a semiconductor wafer W along the radius r of the semiconductor wafer W, shown in FIG. 3. Each RR (X, r) indicates the polishing rate at the corresponding wafer position as obtained when polishing of the wafer W is carried out while supplying a polishing liquid from the corresponding polishing liquid supply position. The polishing profile, as obtained when polishing is carried out for a certain period of time while supplying the polishing liquid from a particular polishing liquid supply position "X", can be determined by the polishing rates RR (X, r) corresponding to the particular position "X", e.g., the polishing rates (10, r) corresponding to the polishing liquid supply position X=10 (mm). Thus, the polishing rates of the database also indicate polishing profiles as will be obtained when polishing is carried out for a certain period of time.

In the polishing apparatus 20 having the above construction, the semiconductor wafer W is held on the lower surface of the top ring 24 and, by the lifting cylinder, is pressed against the polishing pad 52 on the upper surface of the rotating polishing table 22. The polishing liquid supply nozzle 26 is then pivoted and a polishing liquid Q is supplied from the polishing liquid supply port 26*a* onto the polishing pad 52 to carry out polishing of the surface (lower surface) to be polished of the semiconductor wafer W in the presence of the polishing liquid Q between the surface of the semiconductor wafer W and the polishing pad 52. During the polishing, the supply position (polishing liquid supply position) from which the polishing liquid Q is supplied from the polishing liquid supply port 26*a* is moved in accordance with a predetermined movement pattern by pivoting the polishing liquid supply nozzle 26 while controlling the stepping motor 70 by the controller 66. The movement pattern of the polishing liquid supply position is predicted by the simulator 72, inputted into the controller 66 and determined by the controller 66.

Figure 4:
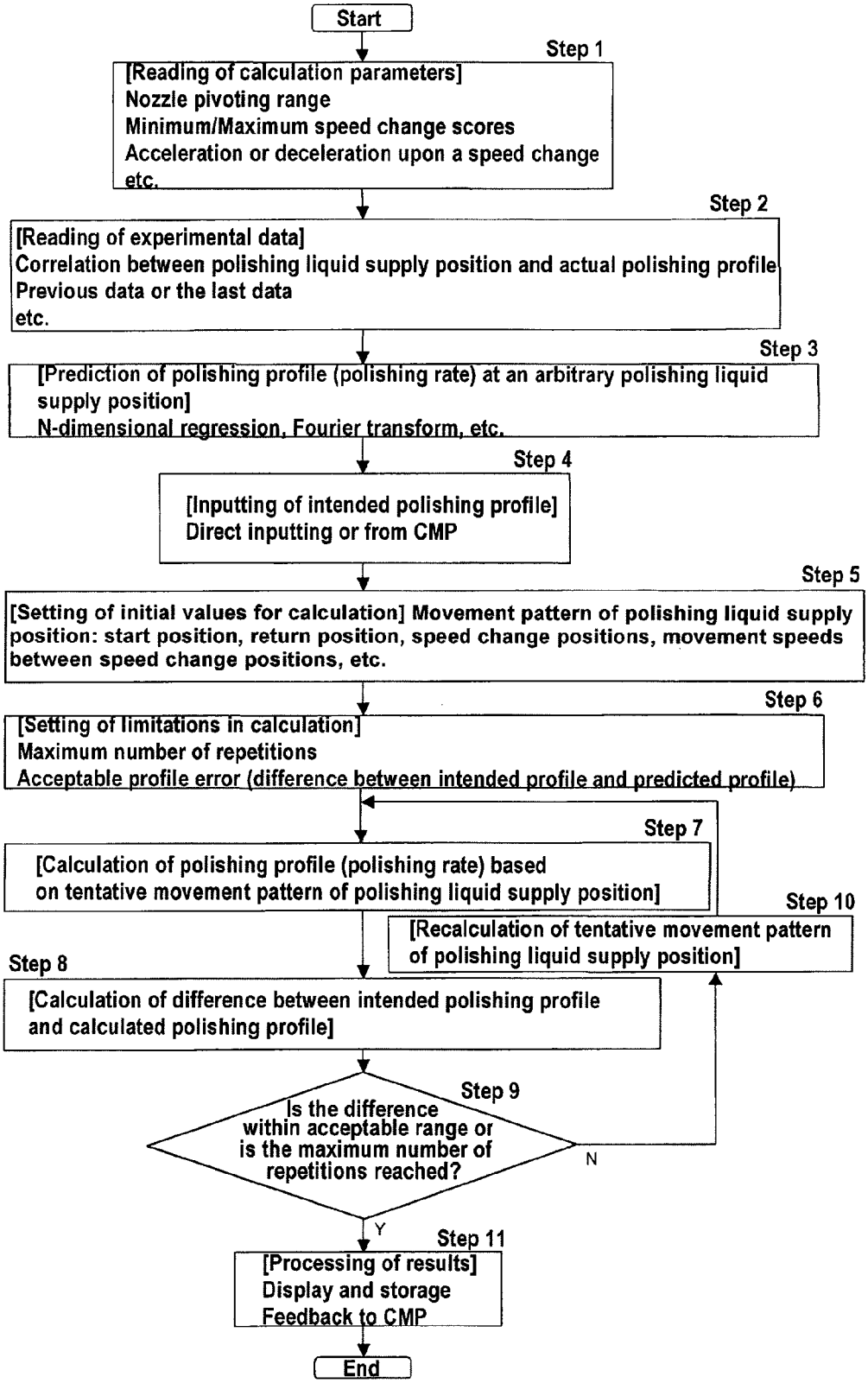
FIG. 4 is a prediction flow chart of a simulation by a simulator.
Figure 5A:
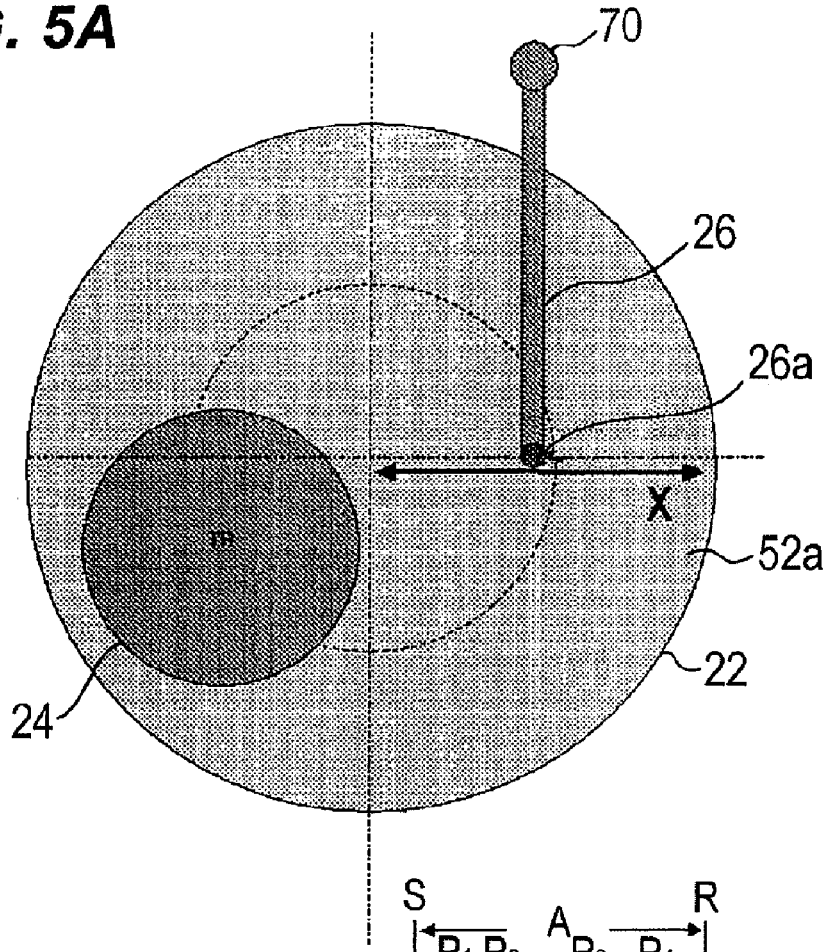
FIG. 5A is a plan view showing the relationship between a polishing surface, a polishing liquid supply nozzle and a polishing liquid supply port (polishing liquid supply position) in a simulation by a simulator.

Prediction of the movement pattern of the polishing liquid supply position, i.e., the polishing liquid supply port 26*a* of the polishing liquid supply nozzle 26, by the simulator 72 will now be described with reference to FIGS. 4, 5A and 5B.

Figure 5B:
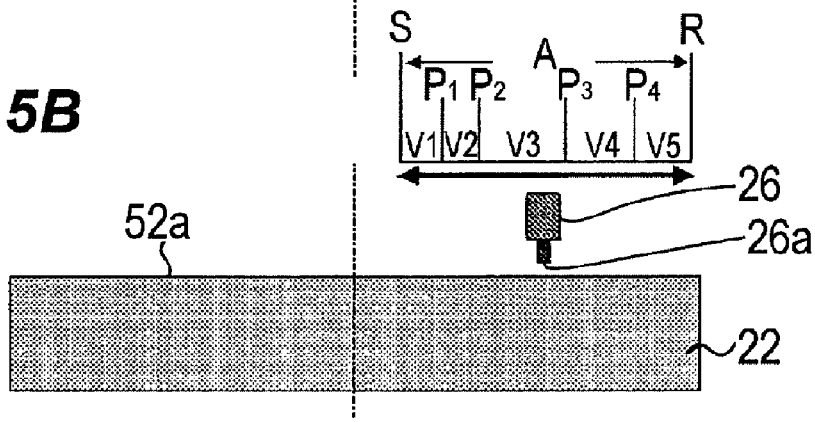
FIG. 5B is a front view of FIG. 5A.

First, the simulator 72 reads calculation parameters, such as the pivotable range of the polishing liquid supply nozzle 26, i.e., the movable range A of the polishing liquid supply port (polishing liquid supply position) 26*a*, shown in FIG. 5B, the minimum and maximum speed change scores, the acceleration or deceleration upon a speed change, etc. (step 1).

Next, the simulator 72 reads as experimental data the correlation between the polishing liquid supply position of the polishing liquid supply nozzle 26 and the actual polishing profile, e.g., from the previous data or the last data (step 2). By referring to the experimental data showing the relationship between a plurality of polishing liquid supply positions of the polishing liquid supply nozzle 26 and polishing rates (polishing profiles), such as the database shown in Table 1, and using at least one of n-dimensional regression, Fourier transform, spline regression and wavelet transform, as necessary, the relationship between an arbitrary polishing liquid supply position and polishing rate (polishing profile) is predicted and stored (step 3).

On the other hand, an intended polishing profile after polishing is inputted into the simulator 72 either directly or from a polishing apparatus (CMP) (step 4).

Next, initial values for calculation of the movement pattern of the polishing liquid supply position, such as the polishing liquid supply start position S, the polishing liquid supply return position R, the speed change positions $P_1$ to $P_4$, and the movement speeds $V_1$ to $V_5$ of the polishing liquid supply port between the speed change positions S and $P_1$, $P_1$ and $P_2$, $P_2$ and $P_3$, $P_3$ and $P_4$, and $P_4$ and R, shown in FIG. 5B, are set (step 5). Further, limitations in the calculations, such as the maximum number of repetitions, an acceptable profile error (difference between the intended profile and a predicted profile), and the like, are set (step 6).

After the above steps, the simulator 72, by referring to the database shown in Table 1, determines a polishing profile (polishing rate) as will be obtained if polishing is carried out while moving the polishing liquid supply position in a tentative movement pattern of the polishing liquid supply position (step 7).

Then, the simulator 72 calculates a difference between the intended polishing profile and the polishing profile determined by calculation in step 7 (step 8), and determines as to whether the difference is within the range of the acceptable profile error set in step 6 or whether the maximum number of repetitions is reached (step 9).

If the difference between the intended polishing profile and the polishing profile determined by calculation is not within the range of the acceptable profile error, the process is returned to step 7 to recalculate a tentative movement pattern of the polishing liquid supply position (step 10). The procedure may be repeated, and when the difference between the intended polishing profile and a polishing profile determined by calculation has come within the range of the acceptable profile error, or when the maximum number of repetitions set in step 6 is reached even when the difference between the intended polishing profile and a polishing profile determined by calculation has not come within the range of the acceptable profile error, the movement pattern of the polishing liquid supply position, which provides the polishing profile calculated in step 7, is displayed and stored, and inputted into the controller 66 (step 11).

Upon receipt of the input from the simulator 72, the controller 66 controls the stepping motor 70, as the movement mechanism, to pivot the polishing liquid supply nozzle 26 such that the polishing liquid supply port 26*a* of the polishing liquid supply nozzle 26 moves in accordance with the movement pattern of the polishing liquid supply position during polishing.

In this embodiment, a film thickness distribution (polishing profile) of a metal film, such as a copper film, formed in a surface of a semiconductor wafer is measured with the eddy current sensor 58 during polishing of the semiconductor wafer, and the data is inputted into the simulator 72. The simulator instantaneously calculates the difference between the intended polishing profile inputted in step 4 of FIG. 4 and the film thickness distribution (polishing profile) measured with the eddy current sensor 58 during polishing, and performs a simulation of polishing conditions necessary to achieve the intended polishing profile. Bases on the polishing conditions obtained by the simulation, the pivoting pattern of the polishing liquid supply nozzle 26, i.e., the movement pattern of the polishing liquid supply port (polishing liquid supply position) 26*a*, is updated to obtain the intended polishing profile.

Polishing of the semiconductor wafer is thus carried out while controlling the pivoting pattern of the polishing liquid supply nozzle 26 so that the film thickness distribution (polishing profile) of the metal film, such as a copper film, after polishing becomes identical to the intended profile, and is completed.

Figure 6:
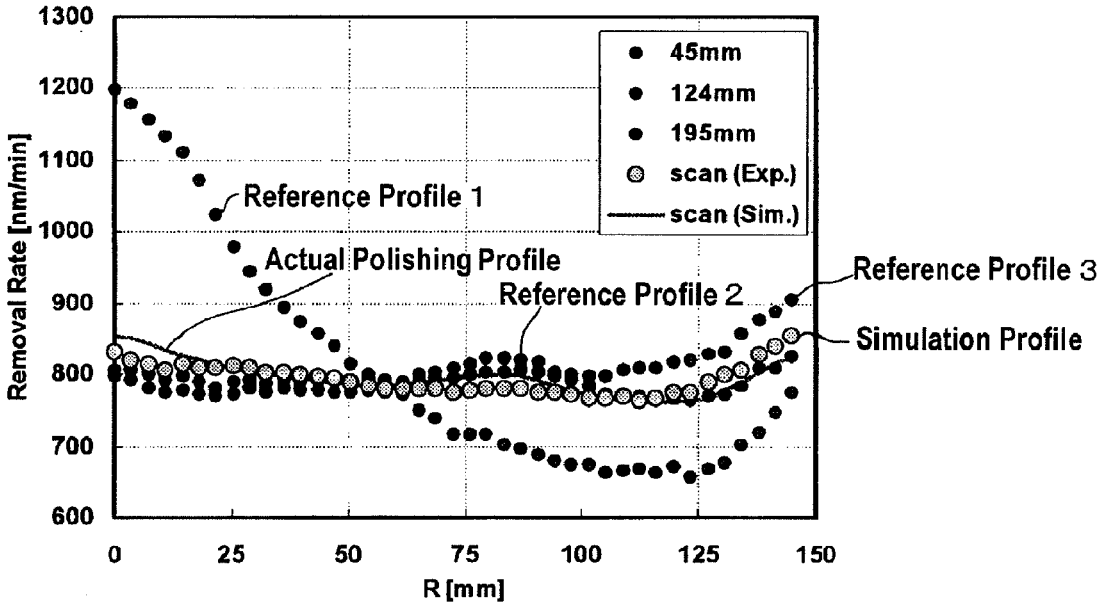
FIG. 6 is a graph showing a simulation profile and an actual polishing profile together with a reference profile.

FIG. 6 is a graph showing a simulation profile and an actual polishing profile together with a reference profile. The reference profile 1 in FIG. 6 represents the relationship between the radial position R (mm) on a 300-mm semiconductor wafer and the polishing rate (Removal Rate) as observed when the semiconductor wafer is polished while supplying a polishing liquid from a position 45 mm away from the center of the polishing surface 52*a* in the X-direction shown in FIG. 5A. The reference profiles 2 and 3 represent the relationships between the radial position R (mm) on a 300-mm semiconductor wafer and the polishing rate (Removal Rate) as observed when the semiconductor wafer is polished while supplying a polishing liquid from positions 124 mm and 195 mm away from the center of the polishing surface 52*a* in the X-direction, respectively. The simulation profile represents a polishing profile as obtained when a simulation is performed by referring to the reference profiles 1 to 3, and the actual polishing profile represents a polishing profile as obtained in actual polishing carried out based on the simulation profile.

As can be seen from FIG. 6, the actual polishing profile, which is very similar to the simulation profile, can be obtained by actually carrying out polishing based on the simulation profile.

For two types of films formed in a polishing object and having different polishing profiles, the movement pattern of the polishing liquid supply position may determined by a simulator individually for each of the films based on a respective intended polishing profile. This can improve the polishing profile of a polishing object having two types of films with different polishing profiles, such as an $SiO_2$ film and a metal film.

Figure 7:
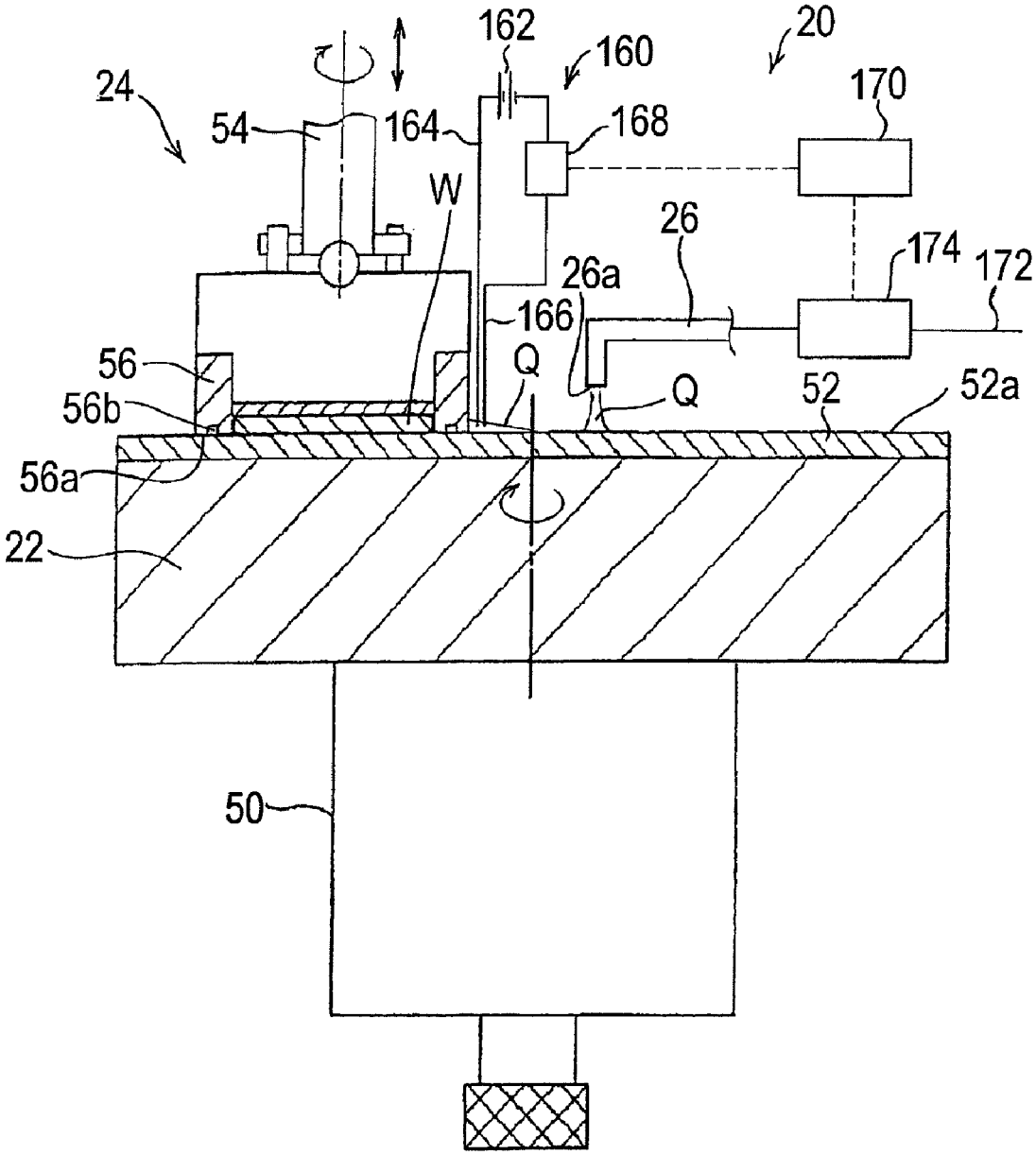
FIG. 7 is a vertical sectional view schematically showing another polishing apparatus.

FIG. 7 is a vertical sectional view showing another embodiment of the polishing apparatus 20. In the polishing apparatus 20 of this embodiment, the polishing liquid supply nozzle 26 is disposed upstream in the movement direction (rotating direction) of the polishing table 22, and a liquid level sensor 160, as a polishing liquid amount monitoring means for monitoring an amount of a polishing liquid Q on the polishing surface 52*a* during polishing, is disposed beside the top ring 24 on the polishing liquid supply nozzle 26 side. The liquid level sensor 160 includes an anode wire 164, exposed at its front end and extending from the positive pole of a power source 162, and a cathode wire 166, exposed at its front end and extending from the negative pole of the power source 162. The anode wire 164 and the cathode wire 166 are disposed opposite each other with their front ends positioned at the same height. An ammeter 168 is interposed in the cathode wire 166.

The polishing liquid Q, supplied to the polishing surface 52*a* from the polishing liquid supply port (polishing liquid supply position) 26*a* of the polishing liquid supply nozzle 26, accumulates beside the top ring 24 on the polishing liquid supply nozzle 26 side. When the level of the accumulated polishing liquid Q has reached a predetermined level at which the lower ends of the anode wire 164 and the cathode wire 166 become immersed in the polishing liquid Q, an electric current flows through the polishing liquid Q between the anode wire 164 and the cathode wire 166. The ammeter 168 detects the electric current, thereby detecting that the level of the polishing liquid Q, which has accumulated beside the top ring 24 on the polishing liquid supply nozzle 26 side, has reached the predetermined level. A signal from the ammeter 168 is inputted into a controller 170.

The polishing liquid supply nozzle 26 is connected to a polishing liquid supply line 172, in which is interposed a flow control unit 174, as a flow control section, for controlling the flow rate of the polishing liquid Q that flows through the polishing liquid supply line 172 and is supplied to the polishing surface 52*a* from the polishing liquid supply port 26*a* of the polishing liquid supply nozzle 26. The flow control unit (flow control section) 174 is connected to the controller 170, and output from the controller 170 is inputted into the unit 174 for control.

In this embodiment, after starting rotation of the polishing table 22, an on-off valve, provided in the flow control unit 174, is opened to start supply of the polishing liquid Q from the polishing liquid supply nozzle 26 to the polishing surface 52*a*. Thereafter, the top ring 24 holding a semiconductor wafer W is lowered while rotating the top ring 24 to press the semiconductor wafer W against the polishing surface 52*a* of the polishing pad 52 at a predetermined pressure, thereby starting polishing of the semiconductor wafer W in the presence of the polishing liquid Q. When the liquid level sensor (polishing liquid monitoring means) 160 detects that the level of the polishing liquid Q, which has accumulated beside the top ring 24 on the polishing liquid supply nozzle 26 side, has reached a predetermined level, the on-off valve provided in the flow control unit 174 is closed to stop the supply of the polishing liquid Q from the polishing liquid supply nozzle 26 to the polishing surface 52*a*. When the liquid level sensor 160 detects that the level of the polishing liquid Q, which has accumulated beside the top ring 24 on the polishing liquid supply nozzle 26 side, has become lower than the predetermined level, the on-off valve, provided in the flow control unit 174, is opened to restart the supply of the polishing liquid Q from the polishing liquid supply nozzle 26 to the polishing surface 52*a*. Such operations are repeated during polishing of the semiconductor wafer W.

Though in this embodiment ON/OFF control is performed by the on-off valve provided in the flow control unit 174 in order to simplify the structure, it is also possible to use a flow controller, provided in the polishing liquid control unit 174, to control the flow rate of the polishing liquid Q, flowing through the polishing liquid supply line 172, before and after the level of the polishing liquid Q, which has accumulated beside the top ring 24 on the polishing liquid supply nozzle 26 side, reaches a predetermined level.

By thus controlling the amount of the polishing liquid Q to be supplied to the polishing surface 52*a* so that the level of the polishing liquid Q, which has accumulated beside the top ring 24 on the polishing liquid supply nozzle 26 side, will not exceed a predetermined level, it becomes possible to meet the demand to reduce the use of the polishing liquid to the least possible amount with a minimum amount of the polishing liquid used.

It is also possible to detect with the liquid level sensor 160 the level of the polishing liquid Q at a predetermined position on the polishing surface 52*a*, e.g., a position beside the top ring 24 on the polishing liquid supply nozzle 26 side. This can monitor the amount of the polishing liquid on the polishing surface 52*a* during polishing.

In this embodiment, the retainer ring 56 has a ring-shaped groove 56*b* circumferentially extending in the contact surface 56*a* which comes into contact with the polishing surface 52*a*. Though not shown diagrammatically, it is also possible to provide a plurality of circumferentially-extending ring-shaped grooves arranged in concentric circles.

The use of the polishing liquid Q can be further reduced by thus forming at least one ring-shaped groove 56*b* in the contact surface 56*a* of the retainer ring 56 which comes into contact with the polishing surface 52*a*, and allowing the polishing liquid Q to flow into the ring-shaped groove 56*b* during polishing.

Figure 8:
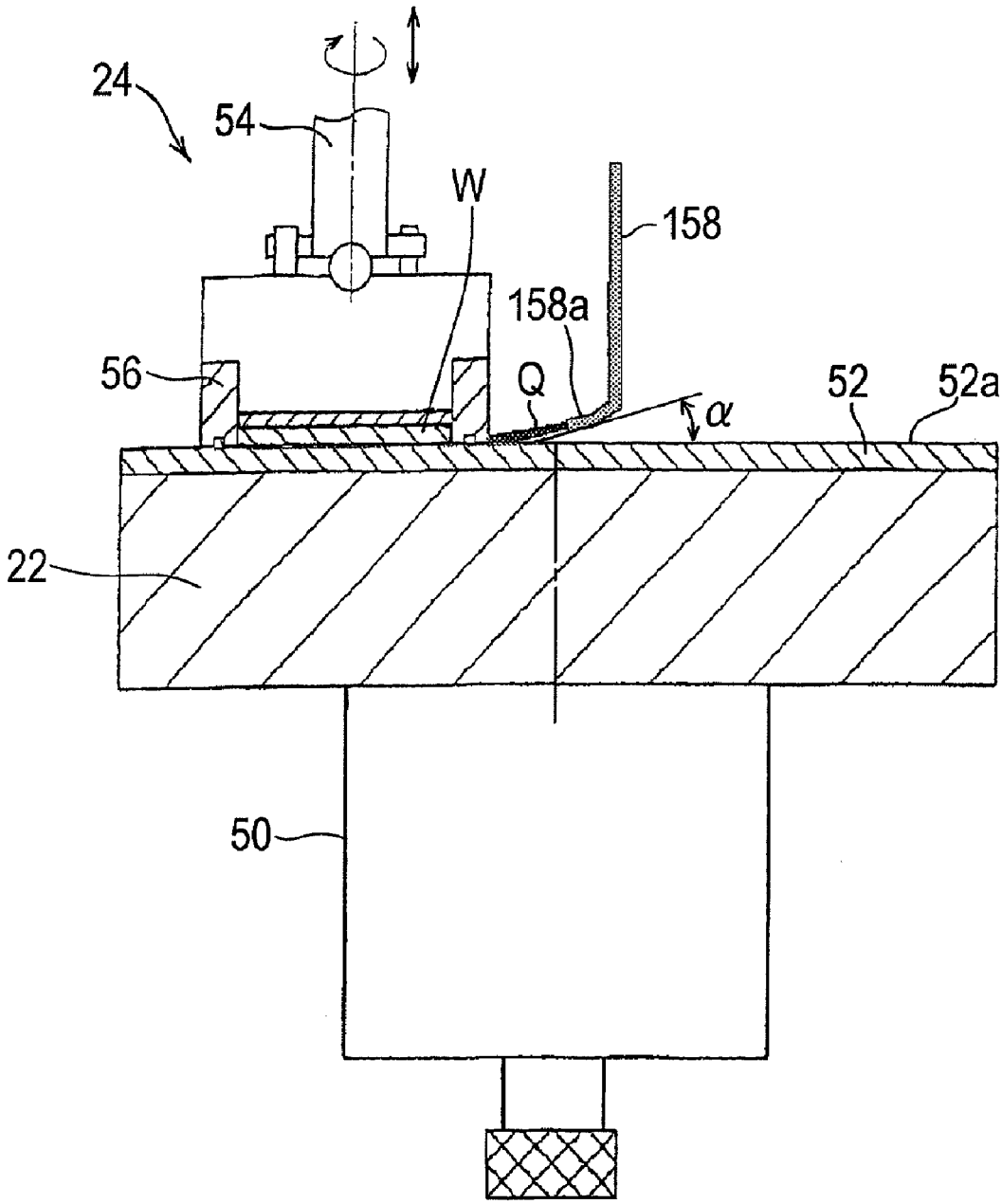
FIG. 8 is a vertical sectional view schematically showing yet another polishing apparatus.

In this embodiment, the polishing liquid supply nozzle 26, which supplies the polishing liquid Q toward the polishing surface 52*a* in a direction almost perpendicular to the polishing surface 52*a*, is used. Instead of the polishing liquid supply nozzle 26, it is possible to use a polishing liquid supply nozzle 158 having, at its front end, an inclined portion 158*a* which is inclined with respect to the polishing surface 52*a* at a predetermined inclination angle $\alpha$, as shown in FIG. 8. This holds true for the below-described embodiments. The inclined portion 158*a* is preferably oriented toward the interface between the top ring 24 and the polishing surface 52*a*, with the inclination angle $\alpha$ being generally not more than 30°.

The provision of the inclined portion 158*a*, which is inclined with respect to the polishing surface 52*a* at a predetermined inclination angle $\alpha$, at the front end of the polishing liquid supply nozzle 158, enables efficient supply of the polishing liquid Q to the polishing surface 52*a*, further between the polishing surface 52*a* and a semiconductor wafer W held by the top ring 24. In particularly, by orienting the inclined portion 158*a* of the polishing liquid supply nozzle 158 toward the interface between the top ring 24 and the polishing surface 52*a*, the polishing liquid Q can be supplied more efficiently between the polishing surface 52*a* and a semiconductor wafer W held by the top ring 24.

Figure 9:
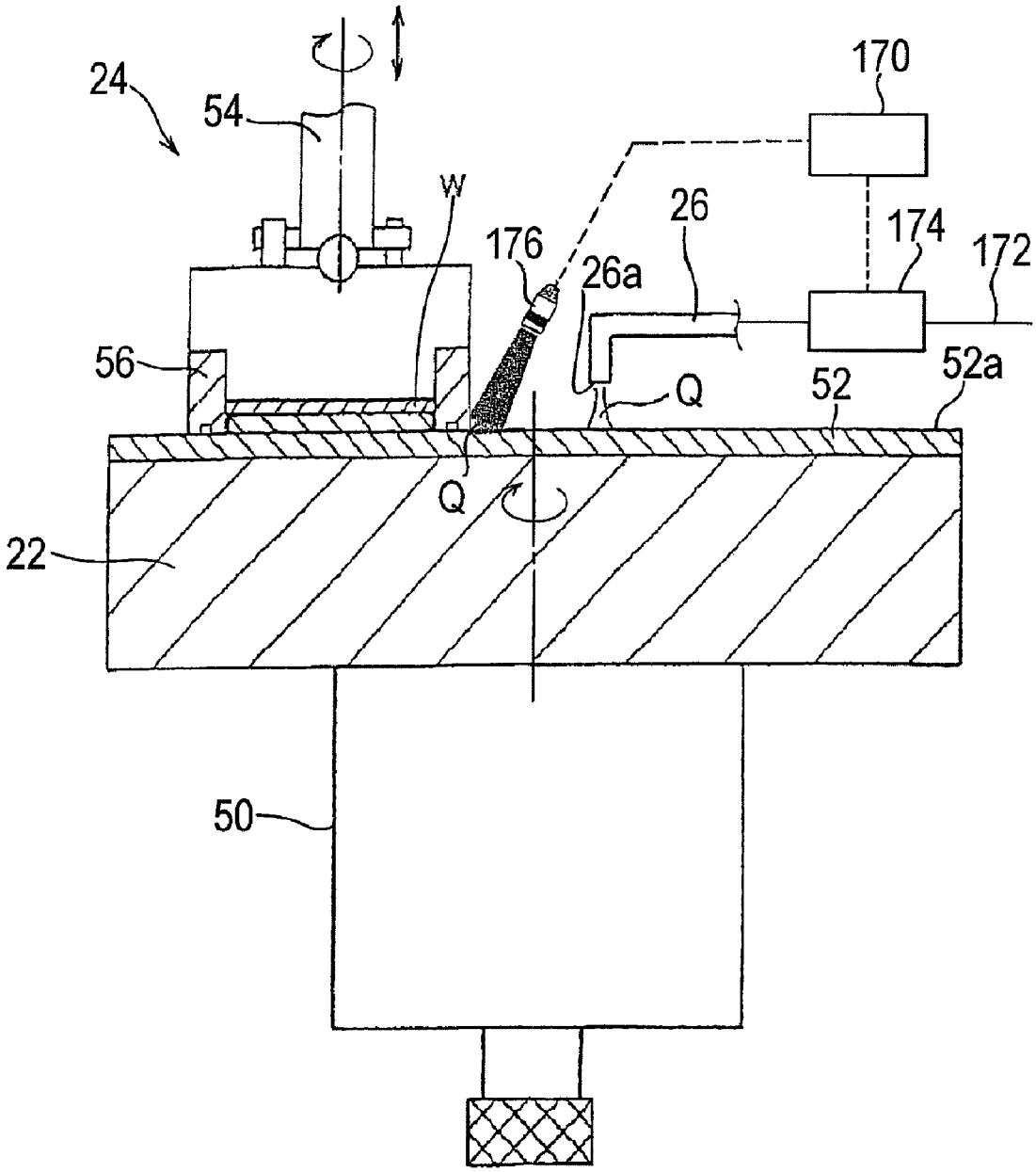
FIG. 9 is a vertical sectional view schematically showing yet another polishing apparatus.

Though in this embodiment the liquid level sensor 160 is used as a polishing liquid monitoring means, it is also possible to use, as a polishing liquid monitoring means, a video camera 176, such as a CCD camera, which performs image processing, as shown in FIG. 9. The video camera (polishing liquid monitoring means) 176 takes a picture of the polishing liquid Q which has accumulated beside the top ring 24 on the polishing liquid supply nozzle 26 side, and performs image processing to detect whether the level of the polishing liquid Q, which has accumulated beside the top ring 24 on the polishing liquid supply nozzle 26 side, has reached a predetermined level.

The amount of the polishing liquid on the polishing surface 52*a* can thus be monitored during polishing also by image recognition using the video camera 176.

Though not shown diagrammatically, it is also possible to dispose two liquid level sensors for detecting different liquid levels beside the top ring 24 on the polishing liquid supply nozzle 26 side, to detect the level of the polishing liquid Q, which has accumulated beside the top ring 24 on the polishing liquid supply nozzle 26 side, e.g., at a level $h_1$ and a level $h_2$ which is higher than $h_1$ ($h_1<h_2$), and to control the level of the polishing liquid Q, which has accumulated beside the top ring 24 on the polishing liquid supply nozzle 26 side, within the range between the two liquid levels ($h_1$-$h_2$)

Figure 10:
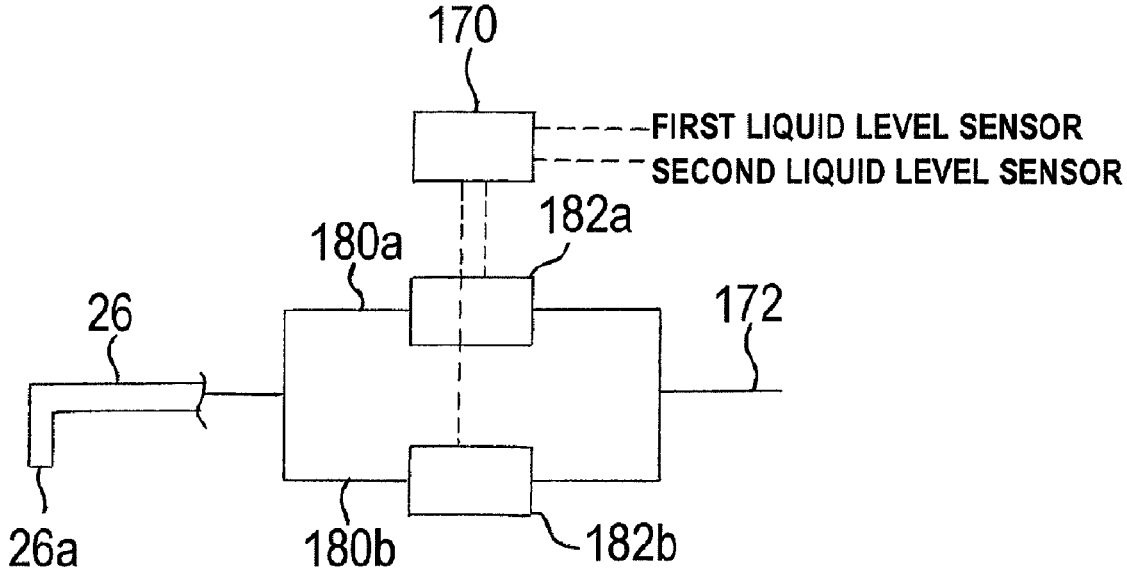
FIG. 10 is a block diagram illustrating another flow control section.

In this case, the flow control section is, for example, comprised of flow control units 182*a*, 182*b* interposed in branch lines 180*a*, 180*b*, respectively, provided in the polishing liquid supply line 172, as shown in FIG. 10. Signals from ammeters of the two liquid level sensors are inputted into the controller 170, and output from the controller 170 is inputted into the flow control units 182*a*, 182*b*.

When one of the liquid level sensors detects that the level of the polishing liquid Q, which has accumulated beside the top ring 24 on the polishing liquid supply nozzle 26 side, has reached the level $h_2$ ($>h_1$), the on-off valve of the flow control unit 182*a* interposed in the one branch line 180*a*, for example, is closed and the polishing liquid Q is supplied to the polishing surface 52*a* through the other branch line 180*b* in such an amount as not to raise the liquid level, thereby gradually lowing the liquid level. When the other liquid level sensor detects that the level of the polishing liquid Q, which has accumulated beside the top ring 24 on the polishing liquid supply nozzle 26 side, has reached the level $h_1$ ($<h_2$), the on-off valve of the flow control unit 182*b* interposed in the other branch line 180*b* is closed and the polishing liquid Q is supplied to the polishing surface 52*a* through the one branch line 180*a* in such an amount as to raise the liquid level, thereby gradually raising the liquid level. By repeating such operations, the level of the polishing liquid Q, which has accumulated beside the top ring 24 on the polishing liquid supply nozzle 26 side, can be controlled within the range between the two liquid levels ($h_1$-$h_2$).

By thus controlling the level of the polishing liquid Q, which has accumulated beside the top ring 24 on the polishing liquid supply nozzle 26 side, within a predetermined range, the consumption of the polishing liquid can be reduced while securely preventing an inadequate supply of the polishing liquid.

The control of the liquid level can be performed with quick response and short time lag especially by interposing the flow control units 182*a*, 182*b* in the branch lines 180*a*, 180*b*, respectively, to control the flow rate of the polishing liquid to be supplied to the polishing surface 52*a*.

Figure 11:
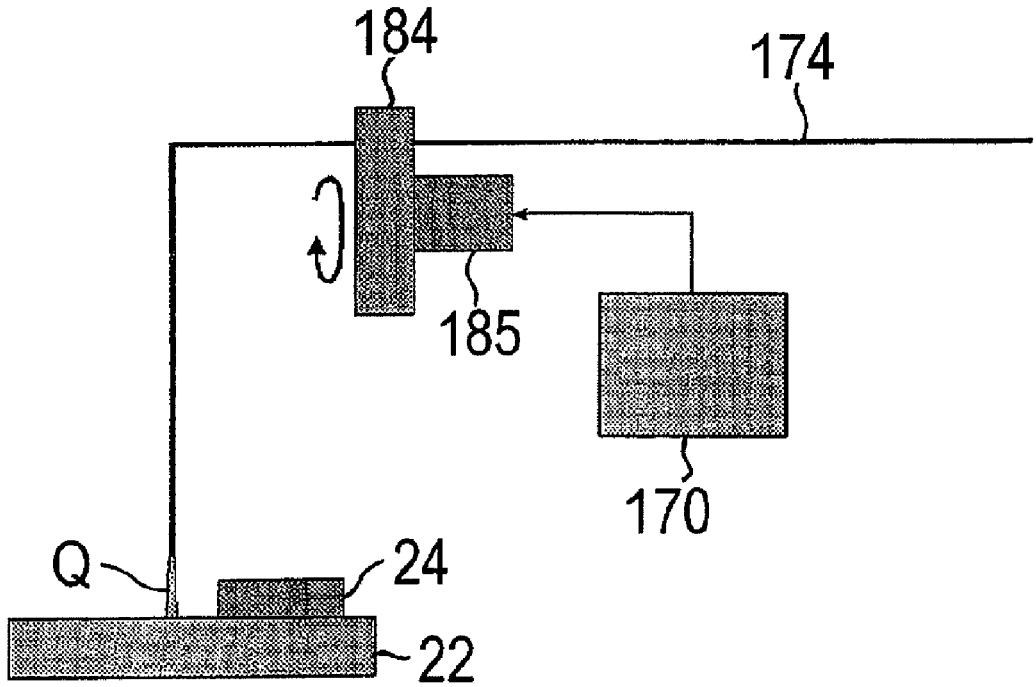
FIG. 11 is a schematic view showing the relationship between a polishing liquid supply line and a rotator interposed in the line.
Figure 12:
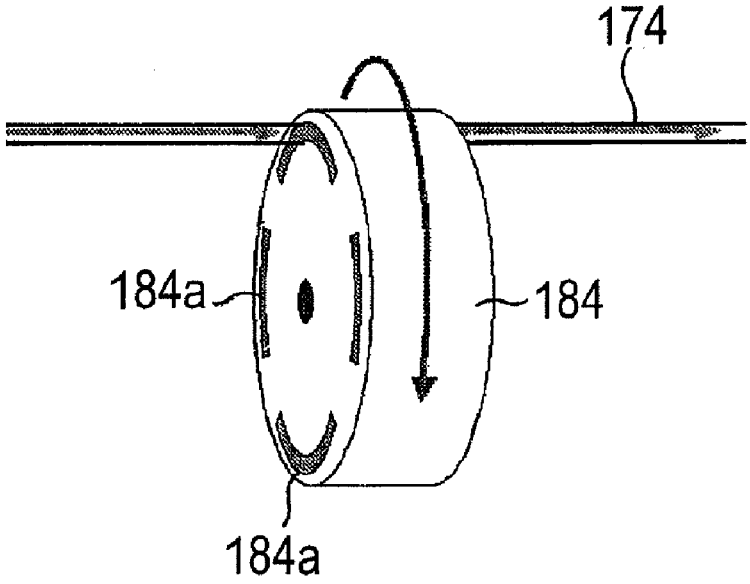
FIG. 12 is an enlarged perspective view of a portion of FIG. 11.

As shown in FIGS. 11 and 12, it is also possible to interpose in the polishing liquid supply line 172 a thick disk-shaped rotator 184 having a plurality of slits 184*a*, each penetrating through the rotator 184 in the thickness direction and extending in the circumferential direction, and use the rotator 184 as at least part of a flow control section. The rotator 184 is rotated by a motor 185 so that the respective slits 184*a* sequential communicate with the polishing liquid supply line 172, whereby the polishing liquid Q is held in the slits 184*a*. In this case, the amount of the polishing liquid Q to be supplied to the polishing surface 52*a* of the polishing table 22 can be adjusted, e.g., by adjusting the rotational speed or angle of the rotator 184 or adjusting at least one of the length and the width of each slit 184*a*.

Though not shown diagrammatically, it is also possible to provide a rotatable rotator, having a plurality of slits for holding a polishing liquid therein, in the vicinity of the polishing liquid supply port of the polishing liquid supply nozzle.

Figure 13:
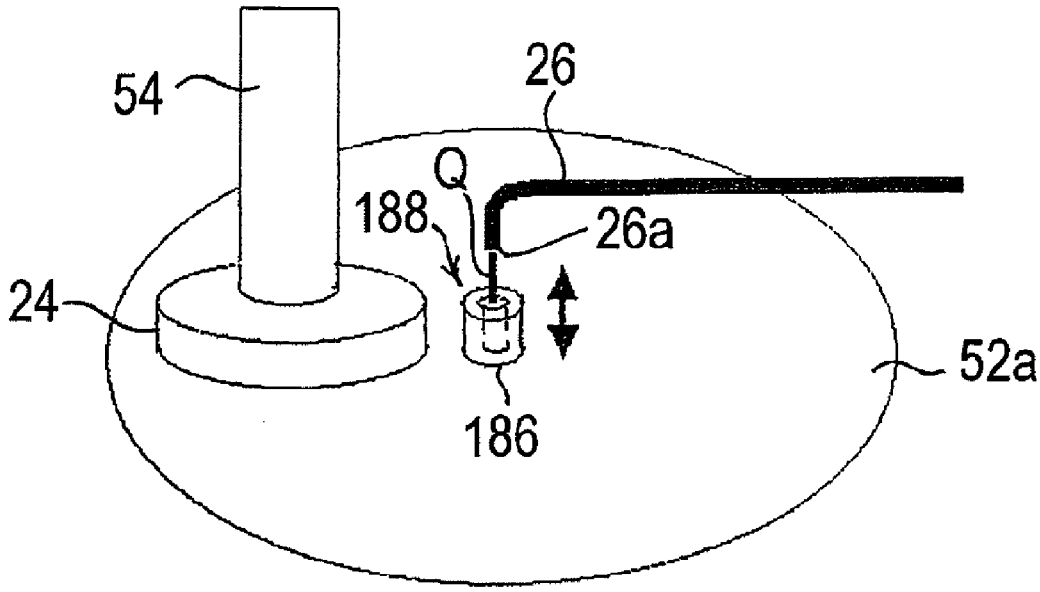
FIG. 13 is a schematic view illustrating a polishing liquid holding mechanism disposed above a polishing surface.

As shown in FIG. 13, it is also possible to dispose a polishing liquid holding mechanism 188, including a vertically movable cylindrical body 186, in the vicinity of the polishing liquid supply port 26*a* of the polishing liquid supply nozzle 26, and use the polishing liquid holding mechanism 188 as at least part of a flow control section. The hollow portion of the cylindrical body 186 of the polishing liquid holding mechanism 188 is in fluid communication with the polishing liquid supply port 26*a* of the polishing liquid supply nozzle 26. When the cylindrical body 186 is lowered and a lower surface is in contact with the polishing surface 52*a*, the polishing liquid Q is held in the hollow portion of the cylindrical body 186. When the cylindrical body 186 is raised and the lower surface detaches from the polishing surface 52*a*, the polishing liquid Q is discharged from the hollow portion of the cylindrical body 186 and supplied to the polishing surface 52*a*.

By thus supplying a polishing liquid Q held in the hollow portion of the cylindrical body 186 to the polishing surface 52*a*, the polishing liquid Q can be held in the hollow portion of the cylindrical body 186 and effectively supplied to the polishing surface 52*a* even when the flow rate of the polishing liquid Q supplied from the polishing liquid supply nozzle is low.

Though not shown diagrammatically, it is also possible to provide in the polishing liquid supply line a polishing liquid holding mechanism which repeats holding and discharge of a polishing liquid.

Figure 14:
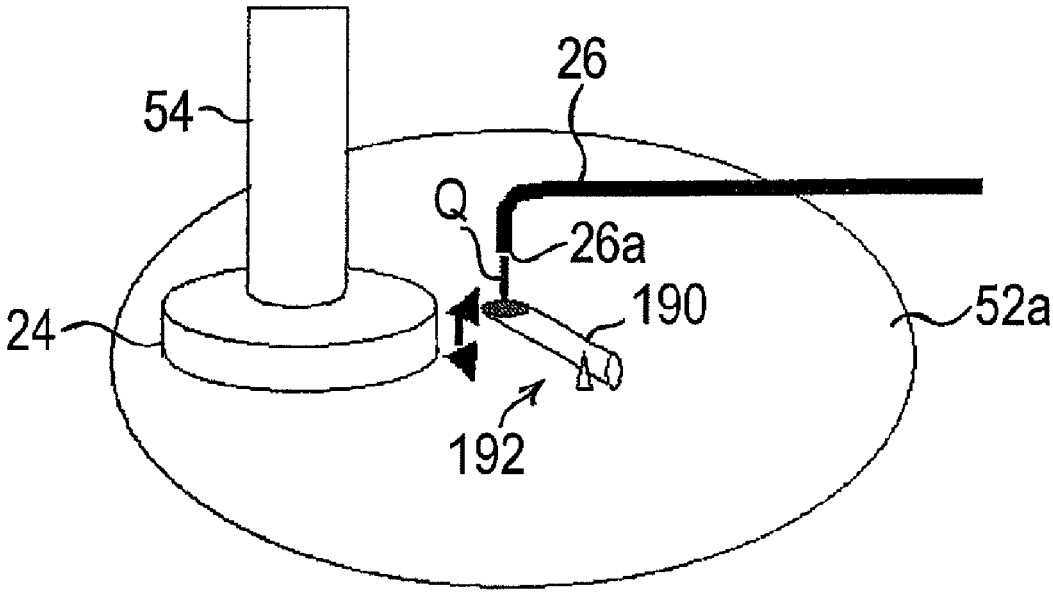
FIG. 14 is a schematic view illustrating a polishing liquid storage mechanism disposed above a polishing surface.

As shown in FIG. 14, it is also possible to dispose a polishing liquid storage mechanism 192, including a bottomed cylindrical container portion 190 supported at a position deviated from the center of gravity rotatably through a predetermined angle, in the vicinity of the polishing liquid supply port 26*a* of the polishing liquid supply nozzle 26, and use the polishing liquid storage mechanism 192 as at least part of a flow control mechanism. The hollow portion of the container portion 190 of the polishing liquid storage mechanism 192 is in fluid communication with the polishing liquid supply port 26*a* of the polishing liquid supply nozzle 26. The opening of the container portion 190 faces upward until a certain amount of polishing liquid is stored in the container portion 190. When the certain amount is reached, the container portion 190 turns downward due to the weights of the container portion 190 and the polishing liquid, so that the opening of the container portion 190 faces downward, whereby the polishing liquid is automatically discharged from the container portion 190 and supplied to the polishing surface 52*a*. After the discharge of the polishing liquid in the container portion 190, the container portion 190 returns to the original position due to its own weight.

By thus supplying the polishing liquid Q held in the hollow portion of the container portion 190 to the polishing surface 52*a*, the polishing liquid Q can be stored in the hollow portion of the container portion 190 and effectively supplied to the polishing surface 52*a* without using power even when the flow rate of the polishing liquid Q supplied from the polishing liquid supply nozzle is low.

Though not shown diagrammatically, it is also possible to provide in the polishing liquid supply line a polishing liquid storage mechanism which repeats temporary storage and automatic discharge of a polishing liquid.

Figure 15:
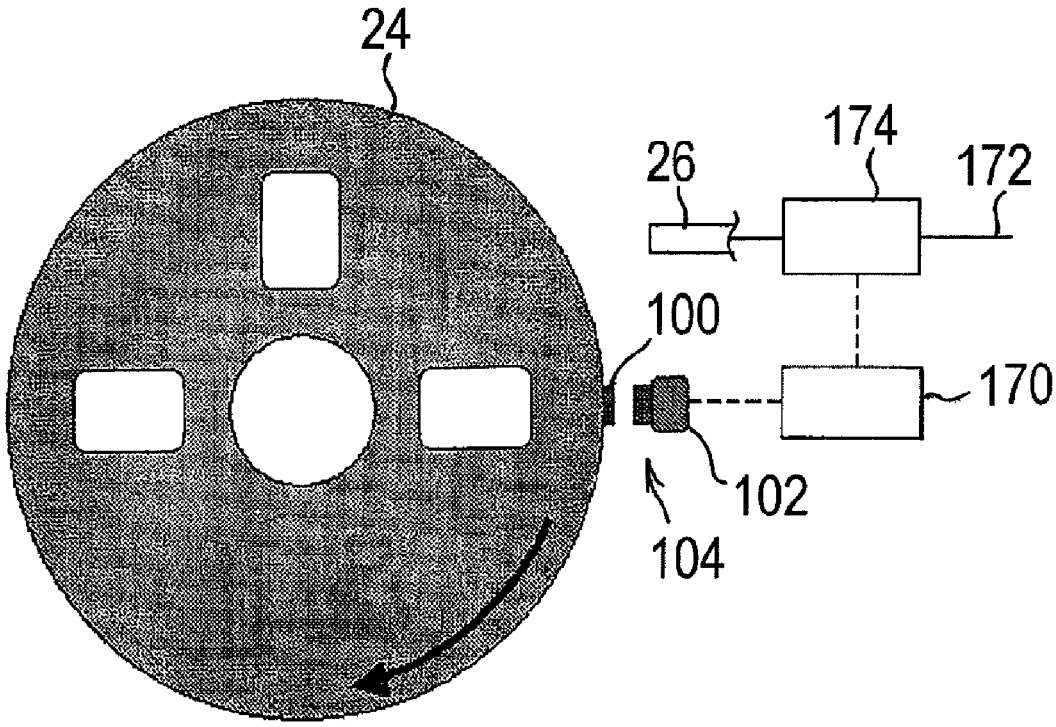
FIG. 15 is a schematic view illustrating the main portion of yet another polishing apparatus.

FIG. 15 shows the main portion of yet another polishing apparatus. The polishing apparatus of this embodiment differs from the polishing apparatus shown in FIG. 7 in that instead of the liquid level sensor (polishing liquid monitoring means) 160 shown in FIG. 7, the apparatus of this embodiment is provided with a rotation measuring means 104 including a dog (detection block) 100 provided on the peripheral surface of the top ring 24, and a detection sensor 102, provided outside the top ring 24, for detecting passage of the dog 100. The output of the detection sensor 102 is inputted into the controller 170. The output of the controller 170 controls the flow control unit 174, as a flow control section, provided in the polishing liquid supply line 172.

In this embodiment, after starting rotation of the polishing table 22, an on-off valve, provided in the flow control unit 174, is opened to start supply of a polishing liquid Q from the polishing liquid supply nozzle 26 to the polishing surface 52*a*. Thereafter, the top ring 24, holding a semiconductor wafer W, is lowered while rotating the top ring 24 to press the semiconductor wafer W against the polishing surface 52*a* of the polishing pad 52 at a predetermined pressure, thereby starting polishing of the semiconductor wafer W in the presence of the polishing liquid Q. During the polishing, the detection sensor 102 detects passage of the dog 100, provided on the peripheral surface of the top ring 24, and measures the (total) number of rotations of the top ring 24. When the (total) number of rotations of the top ring 24 reaches a predetermined value, the flow controller provided in the flow control unit 174 is controlled to adjust the amount of the polishing liquid supplied from the polishing liquid supply nozzle 26 to the polishing surface 52*a*. The adjustment of the supply of the polishing liquid may be performed every time the (total) number of rotations of the top ring 24 reaches the predetermined value.

By thus adjusting the flow rate of the polishing liquid Q, supplied from the polishing liquid supply nozzle 26 to the polishing surface 52*a*, by the flow control unit (flow control section) 174 before or after the (total) number of rotations of the top ring 24 reaches a predetermined value, it becomes possible to reduce the amount of the polishing liquid used while maintaining a relatively high polishing rate.

Though in this embodiment the (total) number of rotations of the top ring 24 is measured to adjust the amount of the polishing liquid Q to be supplied from the polishing liquid supply nozzle 26 to the polishing surface 52*a*, it is also possible to measure the (total) number of rotations of the polishing table 22 to adjust the amount of the polishing liquid Q to be supplied from the polishing liquid supply nozzle 26 to the polishing surface 52*a*. Besides the rotation measuring means comprising the dog 100 and the detection sensor 102, any other rotation measuring means may, of course, be used.

Figure 16:
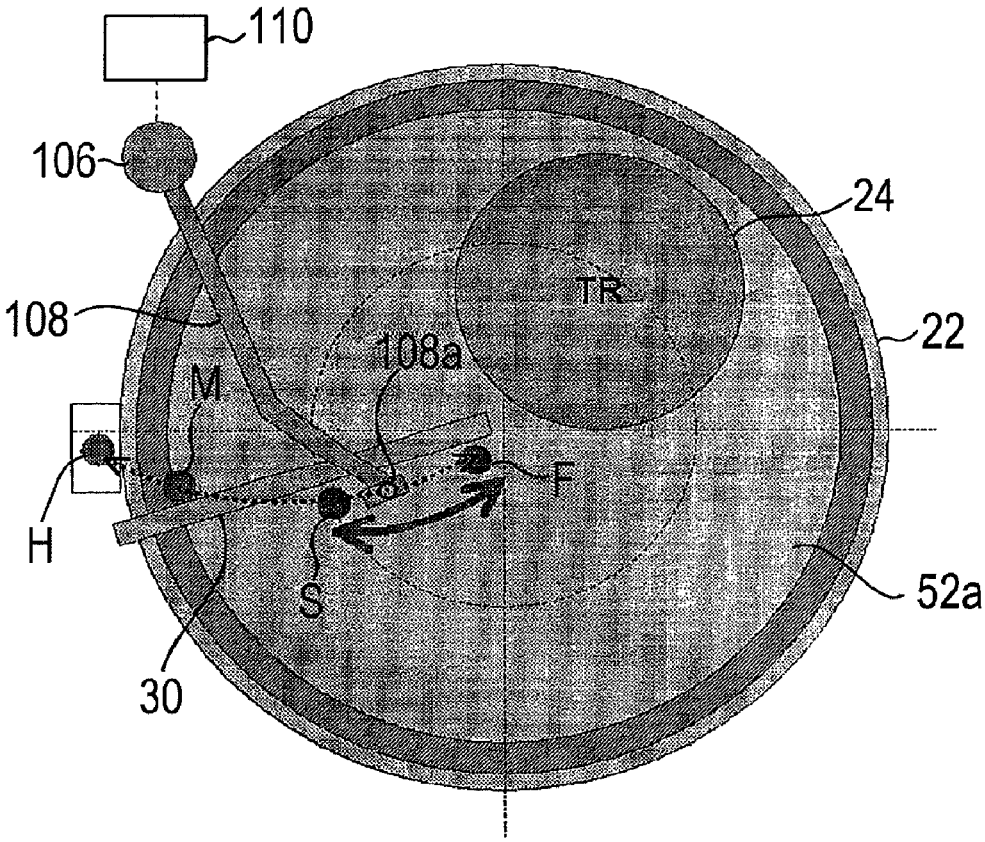
FIG. 16 is a schematic view illustrating the main portion of yet another polishing apparatus.

FIG. 16 shows the main portion of yet another polishing apparatus. This embodiment differs from the polishing apparatus shown in FIG. 7 in that instead of the polishing liquid supply nozzle 26 shown in FIG. 7, a polishing liquid supply nozzle 108, which pivots horizontally by the rotation of a stepping motor 106, is used as a movement mechanism. The polishing liquid supply port (polishing liquid supply position) 108*a* is moved horizontally, and the movement speed of the polishing liquid supply port (polishing liquid supply position) 108*a* is controlled by controlling the stepping motor (movement mechanism) 106 by a controller 110. The liquid level sensor (polishing liquid monitoring means) 160 shown in FIG. 7 is not provided in this embodiment.

In this embodiment, upon polishing, the polishing liquid supply nozzle 108 is pivoted so that the polishing liquid supply port (polishing liquid supply position) 108*a* moves from a position above a home position Hon the periphery of the polishing surface 52*a* to a position above a first supply position F corresponding to the center-side track of an edge of a semiconductor wafer W held by the top ring 24 on the polishing surface 52*a*. During polishing, the polishing liquid supply nozzle 108 is reciprocatingly pivoted so that the polishing liquid supply port 108*a* reciprocatingly moves between the position above the first supply position F and a position above a second supply position S corresponding to the track of the center of the semiconductor wafer W held by the top ring 24 on the polishing surface 52*a*. After the completion of polishing, the polishing liquid supply nozzle 108 is pivoted so that the polishing liquid supply port 108*a* moves to the position above the home position H on the periphery of the polishing surface 52*a*. The pivoting speed of the polishing liquid supply nozzle 108, and thus the movement speed of the polishing liquid supply port (polishing liquid supply position) 108*a* is controlled during polishing by controlling the stepping motor 106 by the controller 110.

Upon maintenance, the polishing liquid supply nozzle 108 is pivoted so that the polishing liquid supply port 108*a* moves from the position above the home position H on the periphery of the polishing surface 52*a* to a position above a maintenance position M beside the polishing surface 52*a*. After the completion of maintenance, the polishing liquid supply nozzle 108 is pivoted so that the polishing liquid supply port 108*a* moves to the position above the home position H on the periphery of the polishing surface 52*a*.

In this embodiment, after starting rotation of the polishing table 22, an on-off valve, provided in the flow control unit 174 shown in FIG. 7, is opened to start supply of a polishing liquid Q from the polishing liquid supply nozzle 108 to the polishing surface 52*a*. At the same time, the polishing liquid supply nozzle 108 is pivoted so that the polishing liquid supply port 108*a* moves from the position above the home position H to the position above the first supply position F. Thereafter, the top ring 24, holding a semiconductor wafer W, is lowered while rotating the top ring 24 to press the semiconductor wafer W against the polishing surface 52*a* of the polishing pad 52 at a predetermined pressure, thereby starting polishing of the semiconductor wafer W in the presence of the polishing liquid Q.

During the polishing of the semiconductor wafer W, the polishing liquid supply nozzle 108 is reciprocatingly pivoted so that the polishing liquid supply port (polishing liquid supply position) 108*a* reciprocatingly moves between the position above the first supply position F and the position above the second supply position S. At this time, the movement speed of the polishing liquid supply port 108*a* is controlled by the controller 110. For example, when the polishing liquid supply port 108*a* moves from the first supply position F to the second supply position S, the movement speed of the polishing liquid supply port 108*a* is controlled such that the movement speed increases gradually or stepwise. On the other hand, when the polishing liquid supply port 108*a* moves from the second supply position S to the first supply position F, the movement speed of the polishing liquid supply port 108*a* is controlled such that the movement speed decreases gradually or stepwise. For example, the movement range between the first supply position F and the second supply position S is divided into 11 movement sections, and the optimal movement speed of the polishing liquid supply port 108*a* is set for each movement section.

The flow rate of the polishing liquid supplied from the polishing liquid supply port 108*a* to the polishing surface 52*a* may be controlled during the polishing.

After the completion of required polishing of the semiconductor wafer W, the polishing liquid supply nozzle 108 is pivoted to move the polishing liquid supply port 108*a* to the position above the home position H.

When a polishing object, such as a semiconductor wafer, is polished in a plurality of polishing steps, e.g., in two polishing steps consisting of the first polishing step of polishing away most of a conductive film, such as a copper film, on a barrier film, and the second polishing step of removing the conductive film until the barrier film becomes exposed, it is preferred to set the movement speed of the polishing liquid supply port 108*a* for the each movement section and for each polishing step. This makes it possible to significantly reduce the use of a polishing liquid while maintaining a high polishing rate in each polishing step.

It is common practice to supply a polishing liquid to the polishing surface 52*a* in advance of polishing. When supplying a polishing liquid to the polishing surface 52*a* prior to polishing of a polishing object, such as a semiconductor wafer, the movement speed of the polishing liquid supply port 108*a* is preferably set for the each movement section. This makes it possible to optimize the distribution on the polishing surface 52*a* of the polishing liquid supplied to the polishing surface 52*a* prior to polishing of a polishing object, thereby reducing the use of the polishing liquid.

It is also common practice to supply a polishing liquid to the polishing surface 52*a* while rinsing or cleaning a polishing object after polishing, or while dressing the polishing surface 52*a*. When a polishing liquid is supplied to the polishing surface 52*a* while rinsing or cleaning a polishing object after polishing, or while dressing the polishing surface 52*a*, it is preferred to set the movement speed of the polishing liquid supply port 108*a* for the each movement section. This can reduce the amount of the polishing liquid supplied to the polishing surface 52*a* during rinsing or cleaning of the polishing object after polishing or during dressing of the polishing surface 52*a*.

Figure 17:
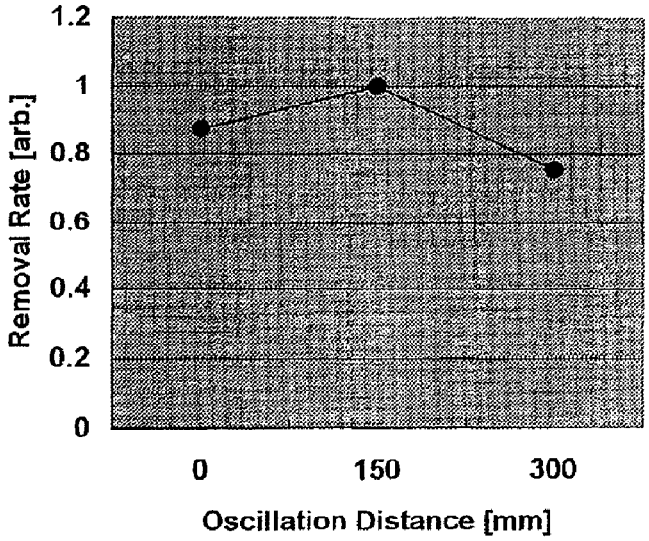
FIG. 17 is a graph showing the relationship between the movement distance (Oscillation Distance) of a polishing liquid supply port and polishing rate (Removal Rate) as observed when polishing is carried out using the polishing apparatus shown in FIG. 16 with the polishing liquid supply port (polishing liquid supply position) kept stationary or moving.

FIG. 17 is a graph showing the relationship between the movement distance (Oscillation Distance) of the polishing liquid supply port 108*a* and polishing rate (Removal Rate) as observed when polishing of a semiconductor wafer, having a diameter of 300 mm, is carried out, using the polishing apparatus shown in FIG. 16, while keeping the polishing liquid supply port (polishing liquid supply position) 108*a* stationary at the first supply position F (movement distance 0 mm), moving the polishing liquid supply port 108*a* between the first supply position F and the second supply position S (movement distance 150 mm), or moving the polishing liquid supply port 108*a* between the first supply position F and the home position H (movement distance 300 mm). In FIG. 17, the polishing rate is represented as a relative value, with the polishing rate at the movement distance of 150 mm being 1.

Figure 18:
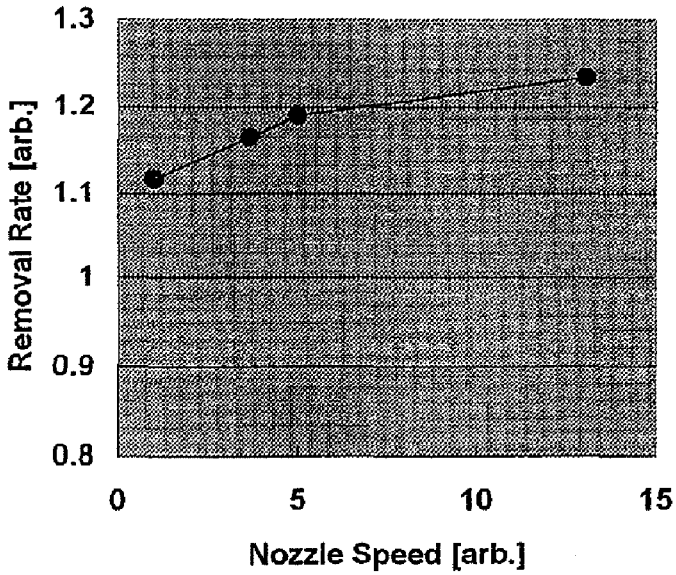
FIG. 18 is a graph showing the relationship between the movement speed (Nozzle Speed) of a polishing liquid supply port (polishing liquid supply position) and polishing rate (Removal Rate) as observed when polishing is carried out using the polishing apparatus shown in FIG. 16 while changing the movement speed of the polishing liquid supply port.

FIG. 18 is a graph showing the relationship between the movement speed (Nozzle Speed) of the polishing liquid supply port 108*a* and polishing rate (Removal Rate) as observed when polishing of a semiconductor wafer, having a diameter of 300 mm, is carried out, using the polishing apparatus shown in FIG. 16, while changing the movement speed of the polishing liquid supply port 108*a*. Regarding the polishing rate, the polishing rate in polishing of the semiconductor wafer as carried out while keeping the polishing liquid supply port 108*a* stationary at the first supply position F is represented as 1. The initial movement speed of the polishing liquid supply port 108*a* is represented as 1.

As can be seen from FIGS. 17 and 18, the polishing rate can be increased by restricting the range of movement of the polishing liquid supply port (polishing liquid supply position) 108*a* during polishing such that a polishing liquid is supplied from the polishing liquid supply port 108*a* during polishing to the limited range corresponding to approximately the radius of a semiconductor wafer, ranging from the center to the edge of the semiconductor wafer, and also by increasing the movement speed of the polishing liquid supply port 108*a*.

Figure 19:
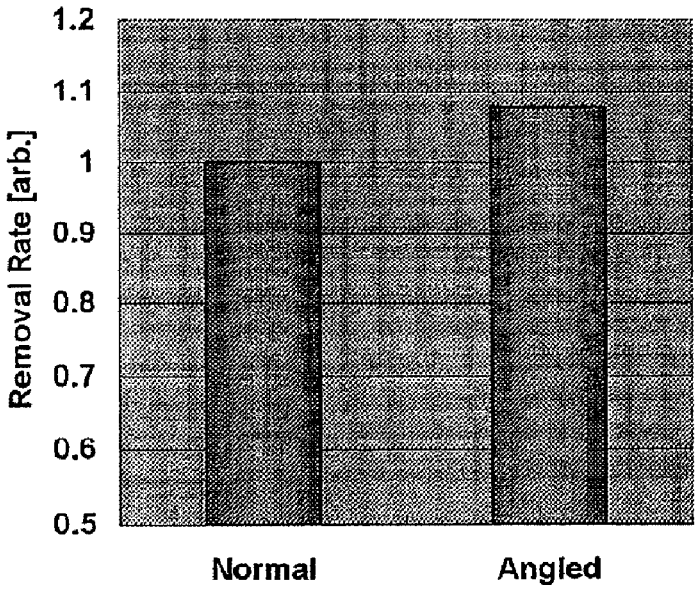
FIG. 19 is a graph showing the polishing rate (Removal Rate) in polishing carried out by using, in the polishing apparatus shown in FIG. 16, a polishing liquid supply nozzle whose front end portion extends vertically and linearly (Normal), or a polishing liquid supply nozzle having an inclined front end portion (Angled)

A polishing liquid supply nozzle having, at its front end, the inclined portion 158*a* shown in FIG. 8 may be used as the polishing liquid supply nozzle 108 shown in FIG. 16. FIG. 19 shows the polishing rate (Removal Rate) in polishing carried out by using a polishing liquid supply nozzle 108 whose front end portion extends vertically and linearly (Normal), or a polishing liquid supply nozzle, as shown in FIG. 8, having an inclined front end portion 158*a* with an inclination angle $\alpha$ of 30°, oriented toward the interface between a top ring and a polishing surface (Angled). In FIG. 19, the polishing rate in polishing as carried out by using the polishing liquid supply nozzle 108 having the vertical and linear front end portion is represented as 1.

As can be seen from FIG. 19, the use of the polishing liquid supply nozzle having the inclined front end portion can increase the polishing rate by about 8% compared to the use of the polishing liquid supply nozzle having the vertical front end portion.

Figure 20:
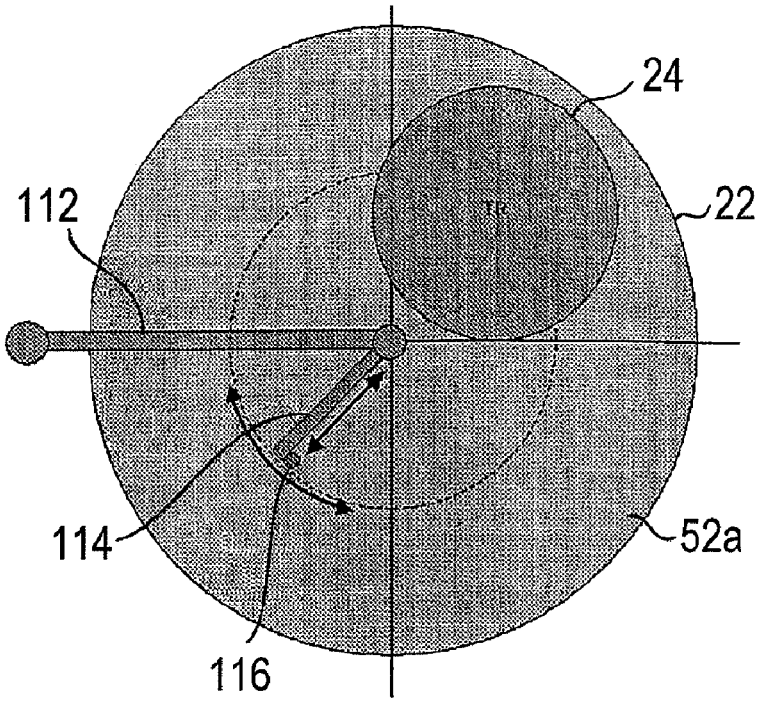
FIG. 20 is a schematic view illustrating the main portion of yet another polishing apparatus.

As shown in FIG. 20, it is also possible to dispose above the polishing surface 52*a* an arm bracket 112, extending in the radial direction of the polishing surface 52*a* and reaching to the center of the polishing surface 52*a*, to pivotably couple a base end of a pivot arm 114 to the front end of the arm bracket 112, and to movably mount a polishing liquid supply nozzle 116, extending vertically and having a polishing liquid supply port (polishing liquid supply position) at the lower end, to the pivot arm 114, so that in accordance with the pivot movement of the pivot arm 114, the polishing liquid supply nozzle 116 moves in the circumferential direction of the polishing surface 52*a*.

Example 1

In the polishing apparatus shown in FIG. 16, the movement range between the first supply position F and the second supply position S was divided into 11 movement sections (oscillation zones 1 to 11) and the movement speed (oscillation speed) of the polishing liquid supply port (polishing liquid supply position) 108*a* was set for each movement section as indicated in Table 2 below, and polishing of a semiconductor wafer, having a diameter of 300 mm, was carried out.

TABLE 2

| | From second supply position to first supply position Center →Edge | | | | From first supply position to second supply position Edge→ Center | | | |
|---|---|---|---|---|---|---|---|---|
| | Start Position [mm] | End Position [mm] | Osci. Dist. [mm] | Osci. Speed [mm/s] | Start Position [mm] | End Position [mm] | Osci. Dist. [mm] | Osci. Speed [mm/s] |
| Oscillation Zone-1 | 195.5 | 177.0 | 18.5 | 15 | 0.0 | 17.7 | 17.7 | 130 |
| Oscillation Zone-2 | 177.0 | 159.3 | 17.7 | 15 | 17.7 | 35.4 | 17.7 | 130 |

TABLE 2-continued

| | From second supply position to first supply position Center →Edge | | | | From first supply position to second supply position Edge→ Center | | | |
|---|---|---|---|---|---|---|---|---|
| | Start Position [mm] | End Position [mm] | Osci. Dist. [mm] | Osci. Speed [mm/s] | Start Position [mm] | End Position [mm] | Osci. Dist. [mm] | Osci. Speed [mm/s] |
| Oscillation Zone-3 | 159.3 | 141.6 | 17.7 | 15 | 35.4 | 53.1 | 17.7 | 130 |
| Oscillation Zone-4 | 141.6 | 123.9 | 17.7 | 40 | 53.1 | 70.8 | 17.7 | 90 |
| Oscillation Zone-5 | 123.9 | 106.2 | 17.7 | 40 | 70.8 | 88.5 | 17.7 | 90 |
| Oscillation Zone-6 | 106.2 | 88.5 | 17.7 | 90 | 88.5 | 106.2 | 17.7 | 90 |
| Oscillation Zone-7 | 88.5 | 70.8 | 17.7 | 90 | 106.2 | 123.9 | 17.7 | 40 |
| Oscillation Zone-8 | 70.8 | 53.1 | 17.7 | 90 | 123.9 | 141.6 | 17.7 | 40 |
| Oscillation Zone-9 | 53.1 | 35.4 | 17.7 | 130 | 141.6 | 159.3 | 17.7 | 15 |
| Oscillation Zone-10 | 35.4 | 17.7 | 17.7 | 130 | 159.3 | 177.0 | 17.7 | 15 |
| Oscillation Zone-11 | 17.7 | 0.0 | 17.7 | 130 | 177.0 | 195.5 | 18.5 | 15 |
| Oscillation time [sec] | | 5.5 | | | | 5.5 | | |

Regarding the start position (Start Position) and end position (End Position) shown in Table 2 of each movement section, the second supply position S shown in FIG. 16 is taken as a start point (0 mm) and the first supply position F as a terminal point (195.5 mm). The distance (Osci. Dist) represents the length of the arc-shaped trajectory of each zone which was obtained by dividing between the first supply position F and the second supply position S into 11 zones. The time taken for one-way movement of the reciprocating movement of the polishing liquid supply port (Oscillation Time) is 5.5 seconds. During polishing, a polishing liquid was supplied at a flow rate of 200 ml/min to the polishing surface 52*a* from the polishing liquid supply port 108*a* of the polishing liquid supply nozzle 108, and the top ring 24 was rotated at a rotational speed of 140 $min^{-1}$ while pressing the semiconductor wafer, held by the top ring 24, against the polishing surface 52*a* at a pressure of 2 psi (13.79 kPa).

Figure 21:
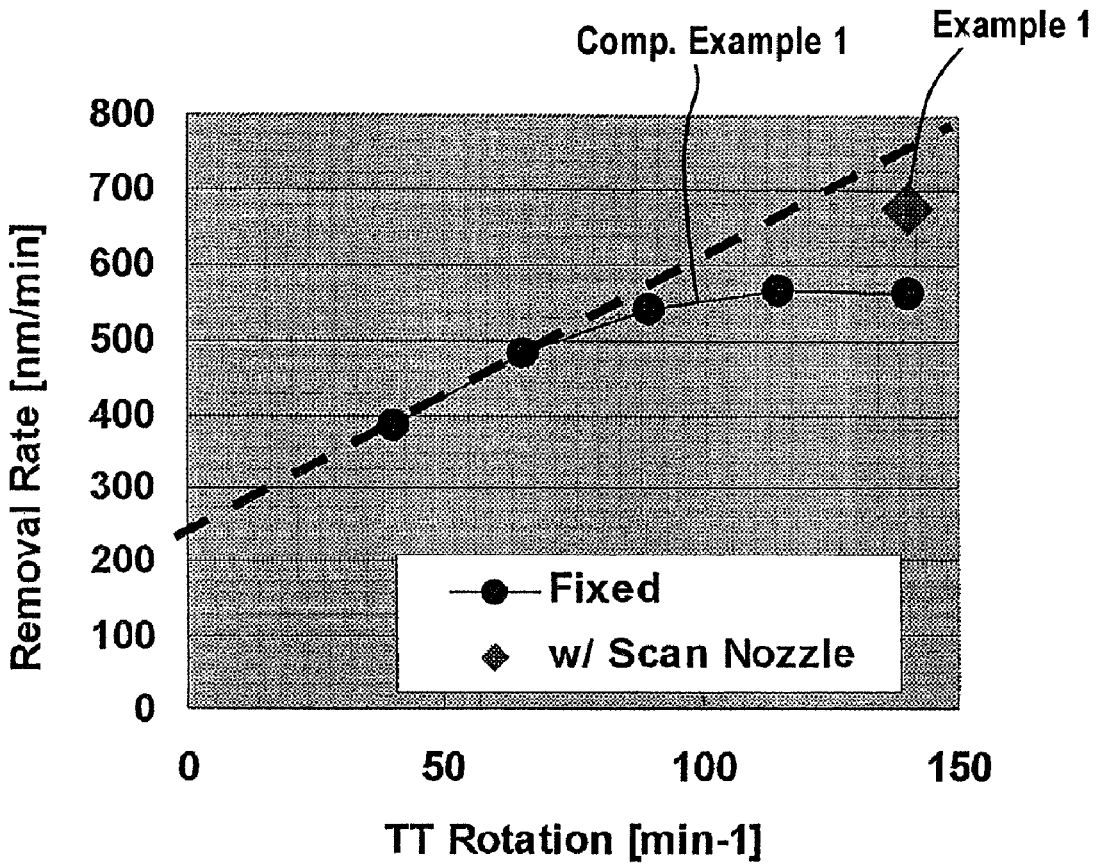
FIG. 21 is a graph showing the polishing rate (Removal Rate) in Example 1 together with the relationship between polishing rate and the rotational speed of top ring (TT Rotation) in Comparative Example 1.
Figure 22:
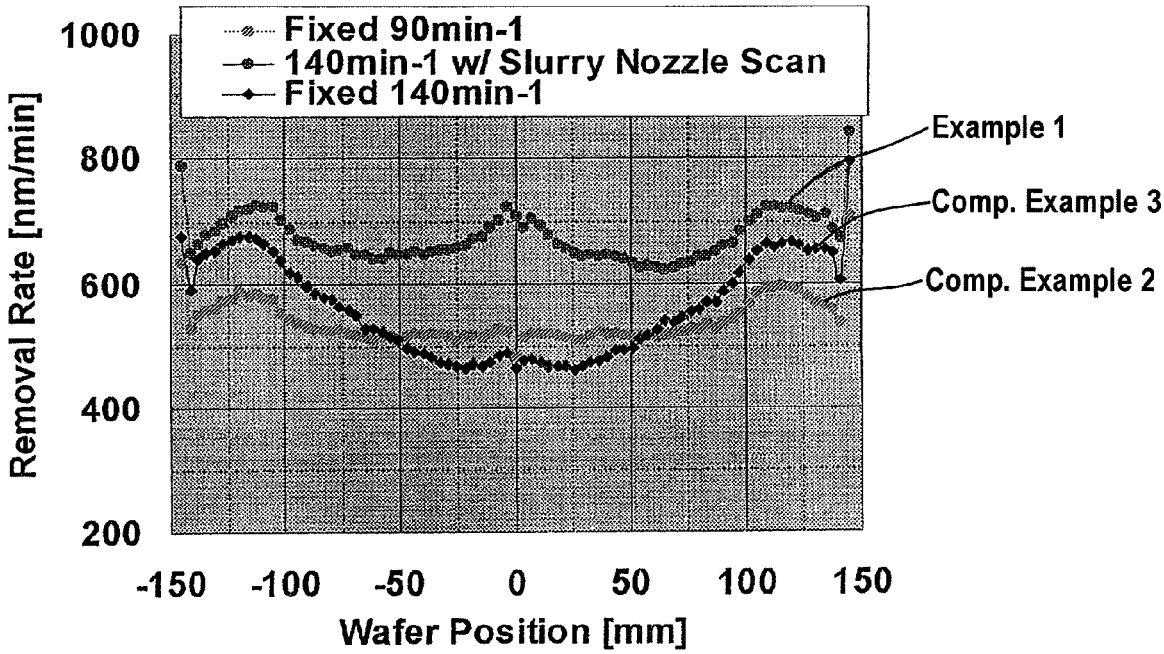
FIG. 22 is a graph showing the relationship between polishing rate (Removal Rate) and position on wafer (Wafer Position) in Example 1 together with those in Comparative Examples 2 and 3.

The polishing rate (Removal Rate) in this polishing is shown in FIG. 21, and the relationship between polishing rate (Removal Rate) and position on the wafer (Wafer Position) in this polishing is shown in FIG. 22. FIG. 21 also shows the relationship between polishing rate and the rotational speed of top ring in Comparative Example 1 in which the same semiconductor wafer was polished in the same manner as in Example 1 except that the polishing liquid supply port 108*a* of the polishing liquid supply nozzle 108 was kept stationary (fixed) at the first supply position F, and that the rotational speed of the top ring (TT Rotation) was varied. FIG. 22 also shows the relationships between polishing rate and position on the wafer in Comparative Examples 2 and 3. In Comparative Example 2, the same semiconductor wafer was polished in the same manner as in Example 1 except that the polishing liquid supply port 108*a* of the polishing liquid supply nozzle 108 was kept stationary (fixed) at the first supply position F, and that the top ring 24 was rotated at a rotational speed of 90 $min^{-1}$. In Comparative Example 3, the same semiconductor wafer was polished in the same manner as in Comp. Example 2 except that the top ring 24 was rotated at a rotational speed of 140 $min^{-1}$.

As can be seen from FIGS. 21 and 22, when polishing is carried out with the polishing liquid supply port 108*a* of the polishing liquid supply nozzle 108 kept stationary at the first supply position F, the polishing rate can be increased by increasing the rotational speed of the top ring 24. The polishing rate, however, does not increase any more when the rotational speed of the top ring 24 exceeds 140 $min^{-1}$. Further, such a high rotational speed of the top ring results in poor flatness of the wafer surface after polishing. On the other hand, when polishing is carried out in the manner of Example 1, the polishing rate can be increased by about 20% and, in addition, the flatness of the wafer surface after polishing can be enhanced as compared to the case where polishing is carried out while keeping the polishing liquid supply port 108*a* stationary at the first supply position F and rotating the top ring 24 at a rotational speed of 140 $min^{-1}$.

Example 2

Polishing of a semiconductor wafer, having a diameter of 300 mm, was carried out in the same manner as in Example 1 except that a polishing liquid was supplied at a flow rate of 100 ml/min to the polishing surface 52*a* from the polishing liquid supply port (polishing liquid supply position) 108*a* of the polishing liquid supply nozzle 108.

Figure 23:
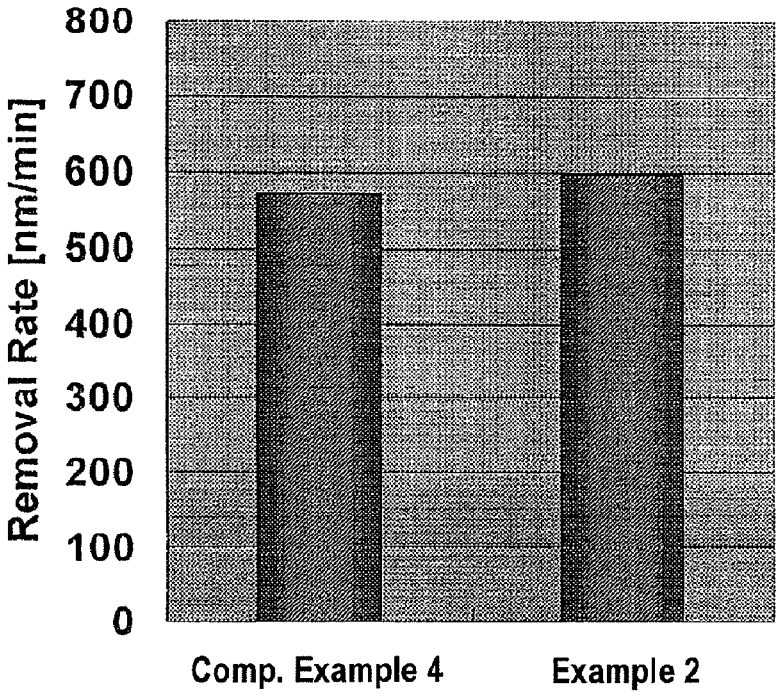
FIG. 23 is a graph showing the polishing rate (Removal Rate) in Example 2 together with that in Comparative Example 4.
Figure 24:
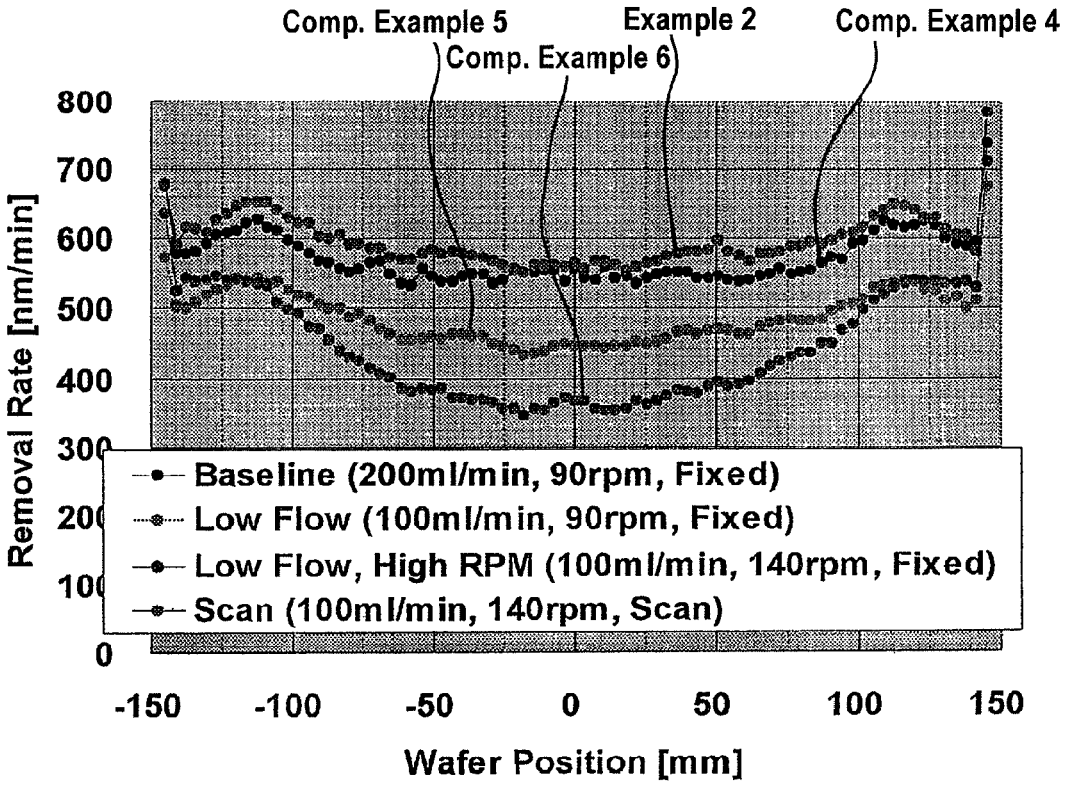
FIG. 24 is a graph showing the relationship between polishing rate (Removal Rate) and position on wafer (Wafer Position) in Example 2 together with those in Comparative Examples 4 to 6.

The polishing rate (Removal Rate) in this polishing is shown in FIG. 23, and the relationship between polishing rate (Removal Rate) and position on the wafer (Wafer Position) in this polishing is shown in FIG. 24. In Comparative Example 4, a semiconductor wafer, having a diameter of 300 mm, was polished in the same manner as in Example 2 except that the polishing liquid supply port 108*a* of the polishing liquid supply nozzle 108 was kept stationary (fixed) at the first supply position F, the polishing liquid was supplied at a flow rate of 200 ml/min to the polishing surface 52*a* from the polishing liquid supply port 108*a* of the polishing liquid supply nozzle 108, and the top ring 24 was rotated at a rotational speed of 90 $min^{-1}$. The polishing rate (Removal Rate) in this polishing is shown in FIG. 23, and the relationship between polishing rate (Removal Rate) and position on the wafer (Wafer Position) in this polishing is shown in FIG. 24. FIG. 24 also shows the relationships between polishing rate and position on the wafer in Comparative Examples 5 and 6. In Comparative Example 5, a semiconductor wafer, having a diameter of 300 mm, was polished in the same manner as in Comp. Example 4 except that the polishing liquid was supplied at a flow rate of 100 ml/min to the polishing surface 52*a* from the polishing liquid supply port 108*a* of the polishing liquid supply nozzle 108. In Comparative Example 6, a semiconductor wafer, having a diameter of 300 mm, was polished in the same manner as in Comp. Example 5 except that the top ring was rotated at a rotational speed of 140 $min^{-1}$.

As can be seen from FIGS. 23 and 24, when polishing is carried out with the polishing liquid supply port 108*a* of the polishing liquid supply nozzle 108 kept stationary at the first supply position F, the polishing rate can be increased by increasing the amount of the polishing liquid supplied. On the other hand, when polishing is carried out in the manner of Example 2, a polishing rate comparable to that of Comp. Example 4, which increased the polishing rate by increasing the amount of the polishing liquid supplied, can be obtained despite the one-half reduction of the use of the polishing liquid from 200 ml/min to 100 ml/min, though the rotational speed of the top ring needs to be increased from 90 $min^{-1}$ to 140 $min^{-1}$.

While the present invention has been described with reference to preferred embodiments, it is understood that the present invention is not limited to the embodiments, but is capable of various modifications within the general inventive concept described herein.

What is claimed is:

1. A polishing apparatus comprising:

a polishing table having a polishing surface;

a top ring for holding a polishing object and pressing the polishing object against the polishing surface;

a polishing liquid supply nozzle for supplying a polishing liquid to the polishing surface;

a movement mechanism for moving a polishing liquid supply position of the polishing liquid supply nozzle approximately along a radial direction of the polishing surface;

a controller for controlling the movement mechanism; and a simulator for predicting a relationship between the polishing liquid supply position of the polishing liquid supply nozzle and a polishing profile, performing a simulation and outputting data to the controller.

2. The polishing apparatus according to claim 1, wherein the simulator, based on input of an intended polishing profile and by referring to a database containing information on pre-determined relationships between a plurality of polishing liquid supply positions and polishing profiles, outputs a movement pattern of the polishing liquid supply position by which the intended polishing profile is expected to be obtained.

3. The polishing apparatus according to claim 1, wherein the simulator, based on input of a movement pattern of the polishing liquid supply position and by referring to a database containing information on pre-determined relationships between a plurality of polishing liquid supply positions and polishing profiles, outputs a polishing profile which is expected to be obtained when polishing is carried out while moving the polishing liquid supply position in accordance with the movement pattern.

4. The polishing apparatus according to claim 1, wherein the simulator, by referring to a database containing information on pre-determined relationships between a plurality of polishing liquid supply positions and polishing profiles, predicts a relationship between an arbitrary polishing liquid supply position and a polishing profile by using at least one of n-dimensional regression, Fourier transform, spline regression and wavelet transform.

5. The polishing apparatus according to claim 1, wherein the simulator, based on superposition of polishing profiles which are weighted by a speed of movement or a residence time of the polishing liquid supply position in an arbitrary small section, predicts a polishing profile which will be obtained if polishing is carried out while moving the polishing liquid supply position.

6. The polishing apparatus according to claim 1, further comprising a film thickness monitor, and the simulator predicts an optimal movement pattern of the polishing liquid supply position from results of measurements with the film thickness monitor during polishing, and feeds back the predicted optimal movement pattern to the controller.

7. The polishing apparatus according to claim 6, wherein the film thickness monitor is an eddy current sensor.

8. The polishing apparatus according to claim 6, wherein the film thickness monitor is an optical sensor.

9. The polishing apparatus according to claim 1, further comprising a polishing profile monitor, and the results of measurement with the polishing profile monitor after polishing are inputted as an actual polishing profile into the simulator.

10. A polishing method for polishing a polishing object by pressing the polishing object against a polishing surface of a polishing table while supplying a polishing liquid from a polishing liquid supply nozzle to the polishing surface and rotating at least the polishing surface, the polishing method comprising:

moving a polishing liquid supply position of the polishing liquid supply nozzle, from which the polishing liquid is supplied to the polishing surface, approximately along a radial direction of the polishing surface and in a predetermined movement pattern, individually determined for each of divided movement sections in a movement range of the polishing liquid supply position, wherein the predetermined movement pattern of the polishing liquid supply position is a movement pattern determined by a simulator based on an intended polishing profile.

11. The polishing method according to claim 10, wherein a difference between an intended polishing profile and a polishing profile measured with a film thickness monitor during polishing is calculated, and a simulation is performed by the simulator based on the calculated difference to update the movement pattern of the polishing liquid supply position so as to bring it closer to a preset polishing profile.

12. A polishing method for polishing a polishing object by pressing the polishing object against a polishing surface of a polishing table while supplying a polishing liquid from a polishing liquid supply nozzle to the polishing surface and rotating at least the polishing surface, the polishing method comprising:

moving a polishing liquid supply position of the polishing liquid supply nozzle, from which the polishing liquid is supplied to the polishing surface, approximately along a radial direction of the polishing surface and in a predetermined movement pattern, individually determined for each of divided movement sections in a movement range of the polishing liquid supply position, wherein for at least two types of films formed in the polishing object and having different polishing profiles, the predetermined movement pattern of the polishing liquid supply position is determined by a simulator individually for each of the films based on an intended polishing profile.

* * * * *